US005901522A

United States Patent [19]

Slater

[11] Patent Number: 5,901,522

[45] Date of Patent: May 11, 1999

[54] COLLAPSIBLE BUILDING TRUSS

[76] Inventor: Jack Slater, 98 Dunedin Drive, Etobicoke, Ontario, Canada, M8X 2K5

[21] Appl. No.: 08/404,459

[22] Filed: Mar. 15, 1995

[51] Int. Cl.[6] ..... E04B 1/32; E04B 7/08

[52] U.S. Cl. ..... 52/641; 52/640; 52/643; 52/645; 52/692

[58] Field of Search ..... 52/641, 643, 645, 52/692, 693, 639, 640

[56] References Cited

U.S. PATENT DOCUMENTS

| | | | |
|---|---|---|---|
| 3,760,550 | 9/1973 | Muewer et al. | 52/641 |
| 4,102,108 | 7/1978 | Cody | 52/693 |
| 4,435,940 | 3/1984 | Davenport et al. | 52/641 |
| 4,546,591 | 10/1985 | Beltz | 52/693 X |
| 4,616,453 | 10/1986 | Sheppard, Jr. et al. | 52/693 X |
| 4,878,323 | 11/1989 | Nelson | 52/643 |
| 4,982,545 | 1/1991 | Stromback | 52/639 |
| 5,297,374 | 3/1994 | Himes | 52/641 |

FOREIGN PATENT DOCUMENTS

| | | | |
|---|---|---|---|
| 1086986 | 2/1955 | France | 52/641 |
| 2551789 | 3/1985 | France | 52/693 |

*Primary Examiner*—Christopher Kent
*Assistant Examiner*—Yvonne Horton-Richardson
*Attorney, Agent, or Firm*—Blake, Cassels & Graydon

[57] ABSTRACT

A truss for use as support for a sloped roof of a building. The truss can be a collapsible metal truss. A method for assembling the truss is described. Each of the of the rafter and beam can include a metal chord all which chords lie in a first plane. Each of struts can include a metal chord located in a second plane parallel to the first plane. There are pivotal connections between various members. The chords of the truss can be moved into a collapsed position for storage and transport of the truss. The chords can be hollow tubes of generally rectangular cross section. The pivotal connections can be nut and bolt connections. The rafter and beam chords can be connected at an eave end to each other by a metal member, and the truss can include an eave extension member. The truss can have chords which are coplanar with each other, each chord of the beam and rafter having a "U"-shaped cross section defining a trough, which trough of the beam opens upwardly and which trough of the rafter opens downwardly, opposing legs of each "U" forming outer walls of the chord on either side of a central plane of the truss.

13 Claims, 23 Drawing Sheets

COLLAPSIBLE BUILDING TRUSS

FIELD OF THE INVENTION

This invention is related to a truss for use as support for a sloped roof of a building. Particularly, this invention relates to a collapsible metal truss and method for assembling same.

BACKGROUND OF THE INVENTION

Trusses that provide structural support for a sloped roof of a building are well known. Traditionally, such trusses have been fabricated on-site, but it is also known to construct a truss in a factory and transport the prefabricated truss to the building site.

A disadvantage of off-site truss fabrication is the problem of storing and transporting such a bulky item. A truss is often designed to span the width of a building and so can be fifteen feet to twenty-five feet or more in length and have a height of three to five feet or more.

Metal building trusses are known, two previous designs being described in U.S. Pat. Nos. 4,435,940 issued to Jeanne Davenport et al. on Mar. 13, 1994, and 4,982,545 issued to Gustav Stromback on Jan. 8, 1991. The specifications of these two patents are incorporated herein by reference.

In a general sense, metal trusses might be preferred over wood in order to avoid a negative impact on forests. More particularly, Davenport et al., have found that a metal truss can be light weight in comparison to a wood truss having comparable load and size specifications. Of course, the overall cost of a truss, including manufacturing costs, shipping, ease of assembly and installation, labor costs, etc., must all be taken into account when evaluating the effectiveness of the truss.

Davenport et al. describe a roof truss having chord members of generally "U"-shaped cross-section. There is a horizontal bottom chord member oriented with the "U" in the upright position and two top chord members having an inverted "U". A truss having a king post and diagonal members of "C"-shaped cross-section connecting the top and bottom chords is shown. For assembly, a length of bottom chord material is cut and positioned atop metal caps to span supporting wall studs and secured to the caps by suitable fasteners, such as screws or nails, depending upon the nature of the caps. The top chords are assembled onto the bottom chord, the legs of the "U" of the bottom chord being received within the channel of the "U" of the top chords and the chords are affixed together by screws, or adhesive or welding. The ends of the top chords at the apex of the truss are affixed together by a plate which straddles the butted ends, again by screws, or adhesive or welding. The top chords extend beyond the ends of the bottom chord to create eaves. Diagonal members are eventually assembled and affixed within the truss structure. A pair of elongate ridge caps are affixed to run between truss apices along the roof peak.

Stromback describes a steel roof truss, developed more recently, which can be assembled on-site. Stromback also shows "U"-shaped chords, which in this case are of roll-formed metal. Each of the chords shown has lengthwise reinforcing ridges formed in the legs and bottom of the "U". Each top chord has a rolled-out flange at the free end of each leg of the "U". Each bottom chord has a rolled flat reinforcing flange at the free end of each leg of the "U". For assembly, the legs of the bottom chord are slipped into the bight of the "U" of the top chord and self-tapping screws are installed in abutting legs for fastening. Web members of "C"-shaped cross-section are installed to run between the top and bottom chords. Shorter vertical segments having a "C"-shaped cross-section are also installed and fastened by self-tapping screws between the top and bottom chords so as to form a load bearing joint located above the wall studs upon which the truss is installed.

SUMMARY OF THE INVENTION

In a broad aspect, the invention is a building truss for supporting a sloped roof. The truss includes a lower beam, an upper rafter and a strut connecting the rafter to the lower beam. Each of the rafter and beam includes a metal chord, which chords are located in a first plane. Each strut includes a metal chord located in a second plane parallel to the first plane. There is a connection between a lower end of the strut chord and the beam chord and there is a connection between an upper end of the strut chord and the rafter chord when the truss is fully assembled. A first of the connections is a pivotal connection having a pivotal axis orthogonal to the planes which connection permits, when the truss is partially assembled such that a second of the connections is disconnected, pivotal movement of the chords of the partially assembled truss with respect to each other. This permits the chords of the truss to be moved into a collapsed position for storage and transport of the truss.

In certain preferred embodiments, each of the chords is a hollow tube of generally rectangular cross section. The pivotal connections are preferably nut and bolt connections and each chord has a pair of preformed communicating apertures therein for receipt of a shank of a bolt therethrough when the truss is fully assembled.

In a preferred embodiment described further below, the rafter and beam chords are connected at an eave end thereof to each other by a metal member, and the truss includes an eave extension member. The eave extension member includes a first metal chord collinear with the chord of the rafter, a second metal chord connected to the first metal chord and located to be coplanar with and below the first chord, and a metal connector connecting the first and second chords and being connected to the metal member, to secure the eave extension member at the eave end of the truss.

In a particular embodiment, each of the lower beam and rafter includes first and second parallel and coextending chords, spaced from each other with respective ends of the strut interposed therebetween. Each chord has a pair of preformed communicating apertures therein for receipt of a shank of a bolt therethrough when the truss is fully assembled. The chords of the beam and the rafter of the fully assembled truss are connected to each other by a connector interposed therebetween, the connector being of generally "C"-shaped horizontal cross section. The truss can be generally triangular, there being two said rafters forming two upper sides of the triangle and in which the lower beam is horizontal and extends, end-to-end, between the connectors.

The truss can be a scissor truss, there being two rafters forming two upper sides thereof, and there being a pair of lower beams, each beam having a outer first end connected to a connector and an inner second end connected to that of the other beam. There can be an eave extension member connected at an end of the fully assembled truss.

A connection for such an embodiment can include a coupling, in which the coupling includes first and second hollow spaced apart parallel tubes, each tube having first and second ends with ends of first and second chords of the beam or rafter, as the case may be, received therein, and a third hollow tube interposed the first and second tubes, pivotally connected thereto and having a first end with an end of the strut chord received therein.

In one embodiment, the strut includes first and second parallel and coextending chords, spaced from each other with respective chords of the beam and rafter interposed between respective ends of the strut chords. Each chord has a pair of preformed communicating apertures therein for receipt of a shank of a bolt therethrough when the truss is fully assembled. Such a truss can be generally triangular, there being two rafters forming two uppers sides of the triangle and the lower beam being horizontal and extending, end-to-end, between the two rafters.

In another embodiment, the first and second planes are coplanar with a central plane of the truss, each of the chords has a pair of opposed walls on either side the central plane, and the connection between the lower end of the strut chord and the beam chord includes a pair of opposed outer metal plates rigidly affixed to the opposed walls of the beam chord. Each plate has a portion extending upwardly of the beam chord, the lower end of the strut chord being located between the portions of the plates, the portions and the opposing walls of the first end of the strut chord having communicating apertures, and a bolt received through the apertures to secure the beam chord and the strut chord together. The connection between the upper end of the strut chord and the rafter chord includes a pair of opposed outer metal plates rigidly affixed to the opposed walls of the rafter chord, each plate having a portion extending downwardly of the rafter chord, the upper end of the strut being located between the portions of the plates, and the portions and the opposing walls of the second end of the strut chord having communicating apertures, and a bolt received through the apertures to secure the rafter chord and the strut chord together.

In another embodiment, the building truss has chords which are coplanar with each other, and each chord of the beam and rafter has a "U"-shaped cross section defining a trough, which trough of the beam opens upwardly and which trough of the rafter opens downwardly, opposing legs of each "U" forming outer walls of the chord on either side of a central plane of the truss. Each strut chord has a rectilinear cross section and includes a pair of outer opposing walls, each wall being on either side of the central plane of the truss. The lower end of the strut chord is received within the trough of the beam chord and, the beam chord and the lower end of the strut chord have communicating apertures in the outer walls thereof through which apertures is received a bolt for securing the beam and strut to each other. The upper end of the strut chord is received within the trough of the rafter chord and the rafter chord and the upper end the strut chord have communicating apertures in the outer walls thereof through which is received a bolt for securing the rafter and strut to each other.

BRIEF DESCRIPTION OF THE DRAWINGS

In the drawings,

FIG. 5*b* shows the particular truss shown in FIG. 2.

FIGS. 12*a*–12*d* show a truss of a second embodiment of the invention. FIGS. 12*b* and 12*c* are partial sections taken through lines b—b and c—c, respectively, of FIG. 2*a*.

FIGS. 13*c* and 13*d* are partial sections taken through lines c—c and d—d, respectively, of FIG. 13*b*.

FIGS. 14*c* and 14*d* are partial sections taken through lines c—c and d—d, respectively, of FIG. 14*b*.

DETAILED DESCRIPTION OF A PREFERRED EMBODIMENT

Figure 1:
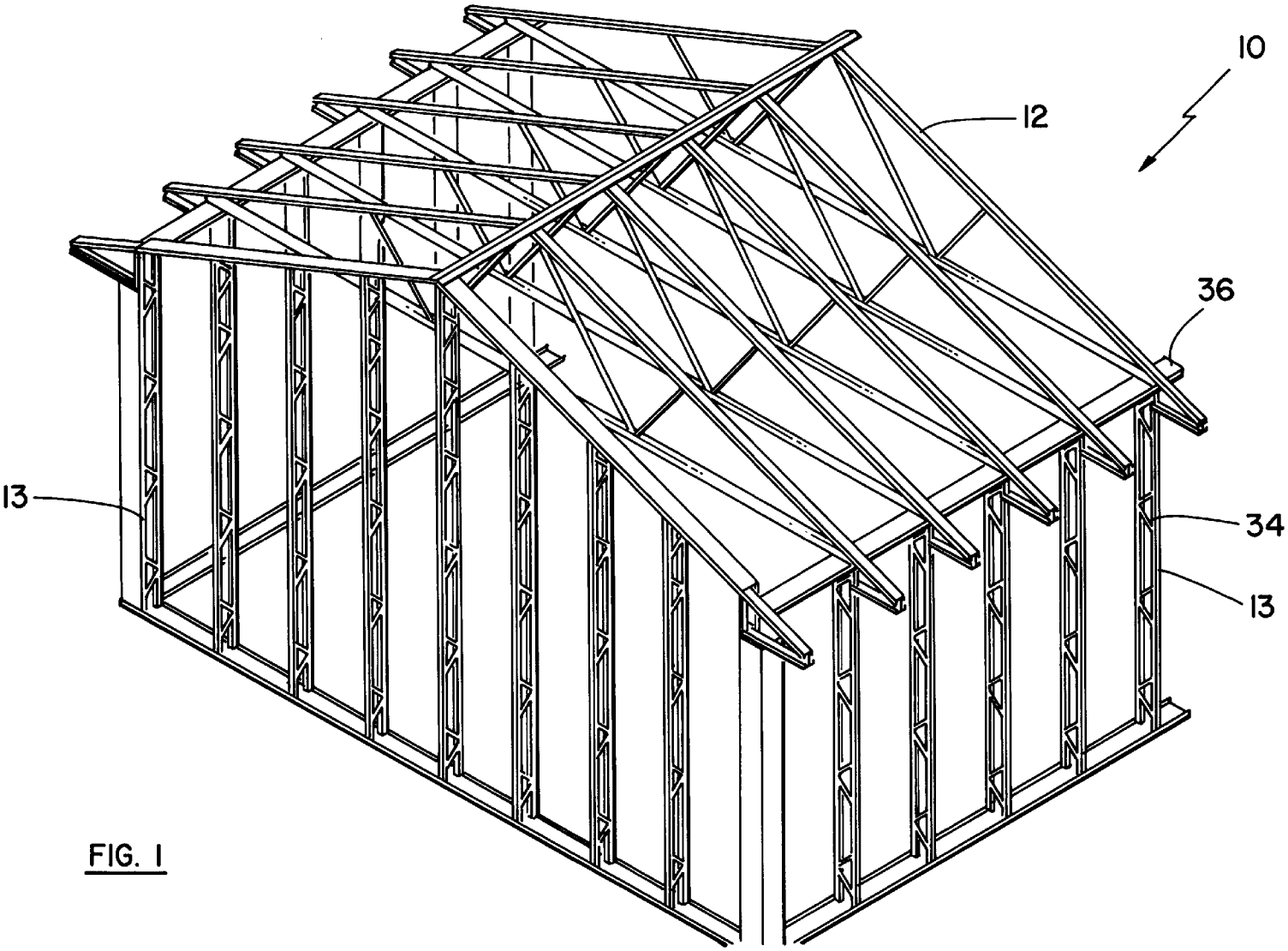
FIG. 1 is an isometric view of a building incorporating a first embodiment truss of the present invention.

Turning to the drawings FIGS. 1 to 11*b* illustrate trusses according to a first embodiment of the invention. In particular, FIG. 1 shows structural components of a building structure 10 incorporating a truss 12. Vertical metal supporting stud members 13 are described in more detail in international patent application published under No. 92/17658.

Figure 2:
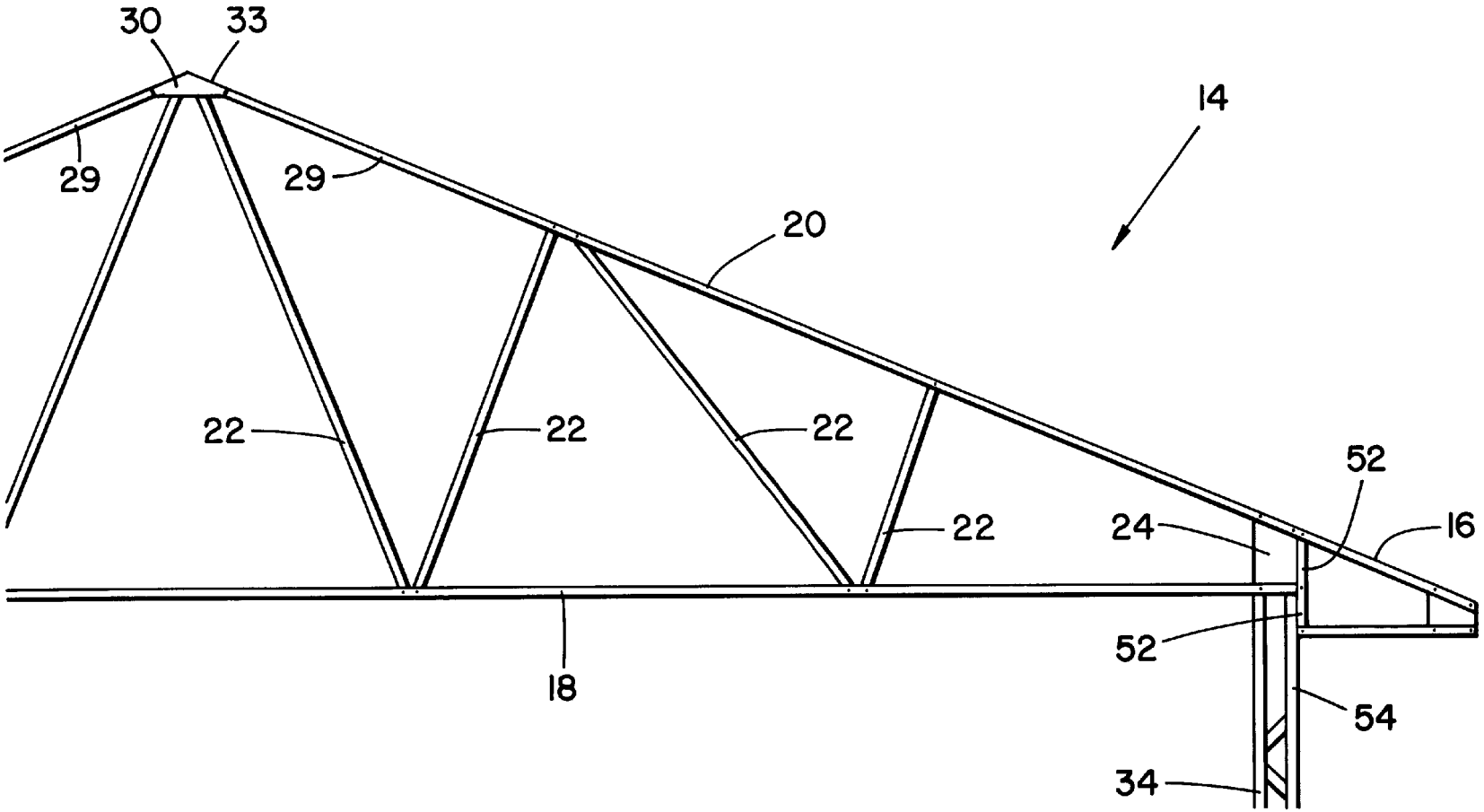
FIG. 2 is a partial side elevation of a six-panel "Fink" truss of the FIG. 1 embodiment.

FIG. 2 shows an assembled "Fink" truss 14 of a particular configuration, in combination with eave extension 16. Truss 14 includes lower horizontal tie beam 18 and rafters 20. The tie beam and rafters are connected each other by means of struts 22 and end connectors 24.

Figure 3C:
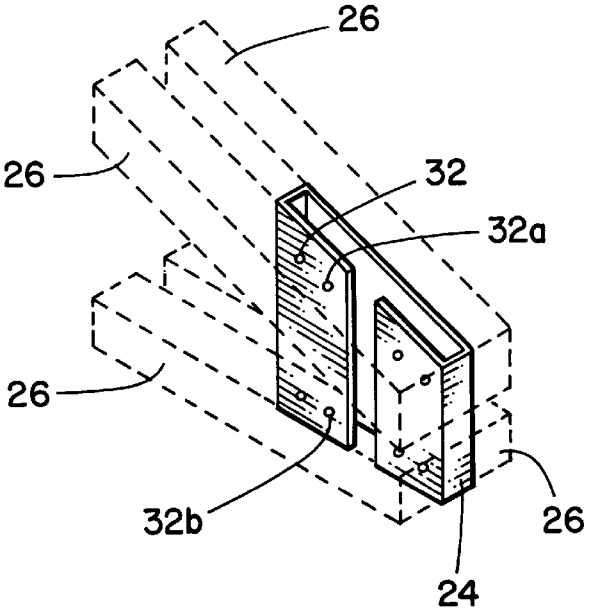
FIGS. 3*a*, 3*b* and 3*c* show an end elevation, a side elevation and an isometric view, respectively, of an end connector for connecting a rafter and tie beam of the FIG. 1 embodiment.
Figure 3B:
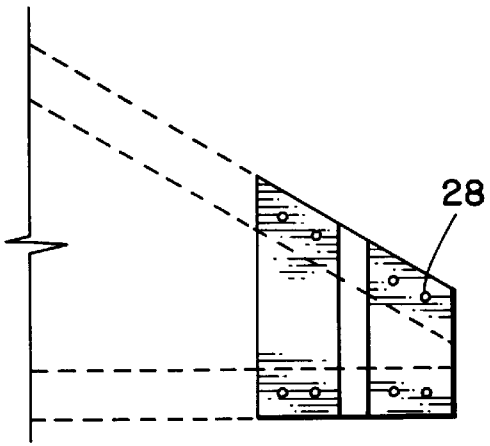
Figure 3A:
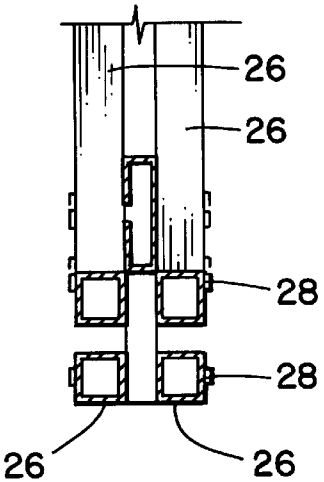
Figure 4A:
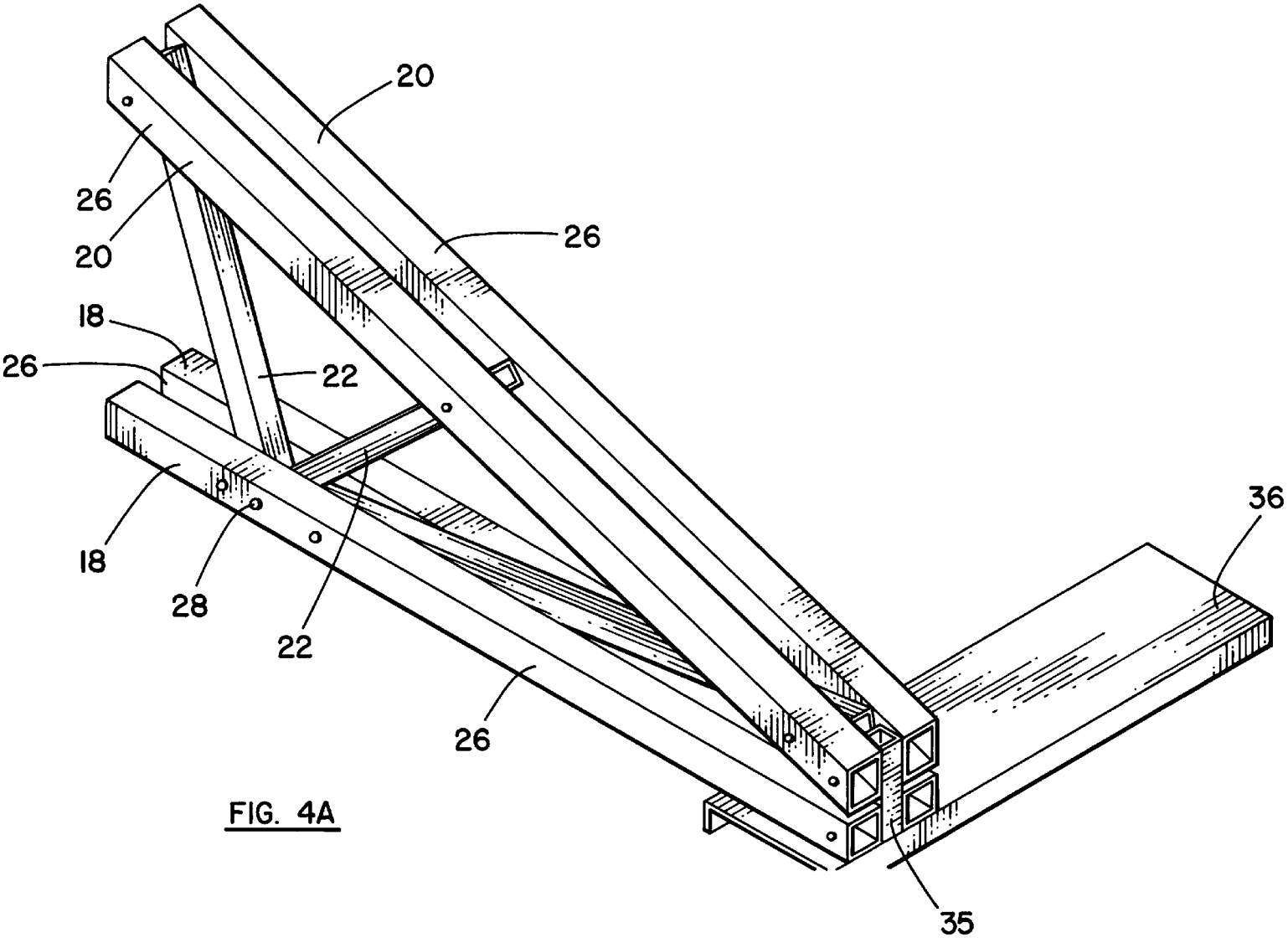
FIGS. 4*a* and 4*b* are perspective and side elevational views, respectively, of the FIG. 1 embodiment truss having an alternate to the connector shown in FIGS. 3*a* to 3*c* connector for connecting a rafter and tie beam.
Figure 4B:
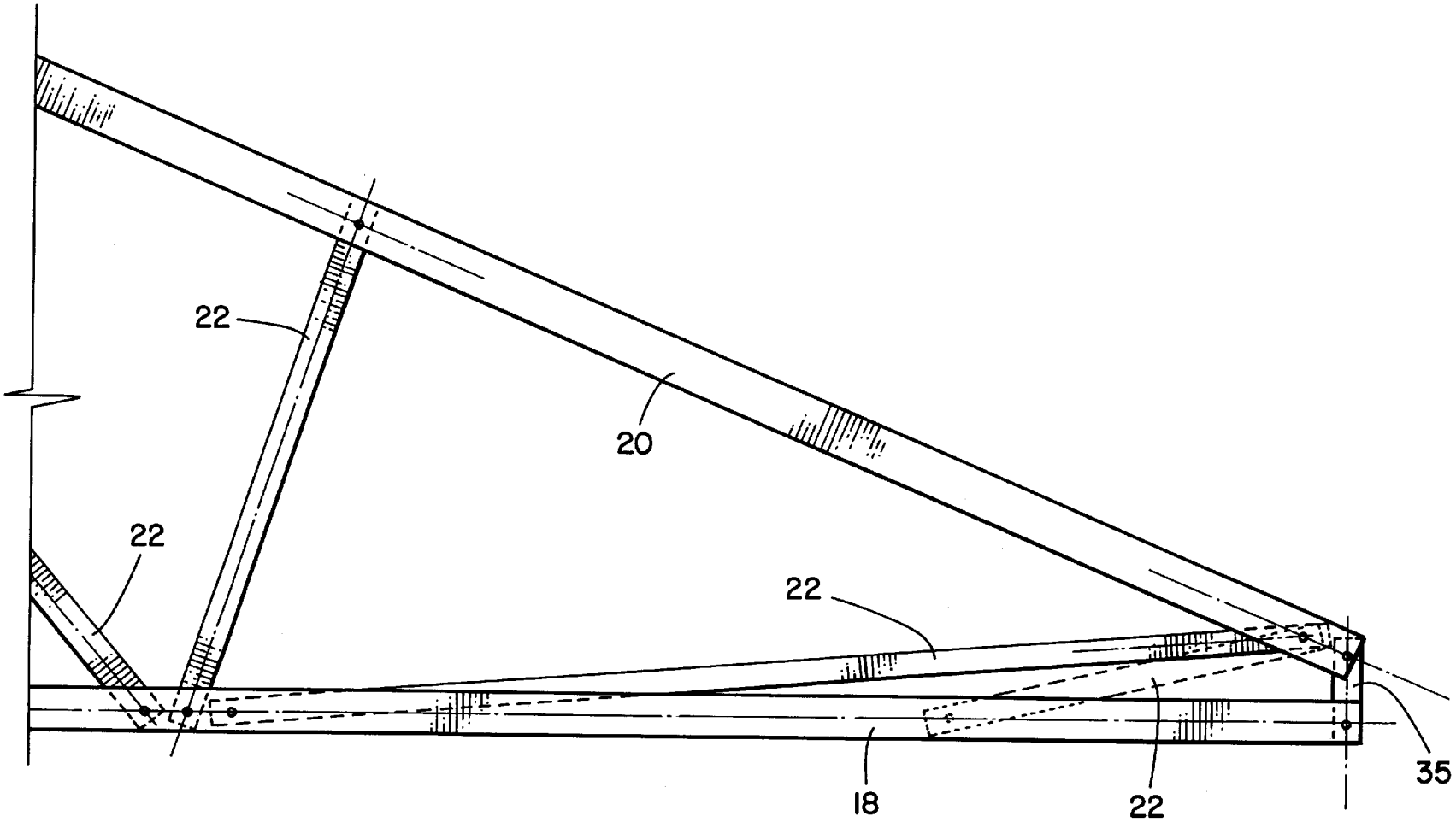

As seen in FIG. 3*a* to 3*c*, each tie beam is made up of two parallel horizontally spaced apart hollow metal chords 26 of square cross-section. Each strut connected to the tie beam is interposed between the pair of chords of the beam and is pivotally connected by means of nut and bolt combination 28.

Each rafter 20, as with the tie beam, is made up of two hollow metal chords 26. Each end of a strut that is connected to a rafter is interposed between the pair of chords of the rafter and is connected by means of nut and bolt combination 28.

The central, or inner longitudinal, ends 29 of the rafters are connected through gusset plate 30 which is secured to the metal chords of the rafters by self tapping screws 33.

In FIGS. 2, 3*a*–3*b*, 7 and 8, each of the outer ends of the rafters are connected to the outer longitudinal ends of tie beam 18 by connector 24. Connector 24 is of generally "C"-shaped cross-section as cut through a horizontal plane of the connector. Each connector 24 is fastened to the tie beam through nut and bolt combinations 28. Each connector is fastened to the rafter to which it is connected by nut and bolt combinations 28 received through apertures 32*a*, 32*b* of the connector and communicating apertures of the chords of the rafter and tie beam, respectively.

Holes 32 for the bolts, used to fasten the components of the truss together, are generally pre-drilled so that the connecting points of the components are pre-located. Connector 24 is of a single piece of metal and the upper holes 32*a* are on a line angled with respect to the line through the two lower holes 32*b* to match the rise/run of the rafter with respect to the tie beam.

An alternate end connector 35 for the first embodiment truss is shown in FIGS. 4*a*, 4*b*, 6*a* and 6*b*. End connector 35 includes a hollow tube of square outer cross-section.

Figure 5A:
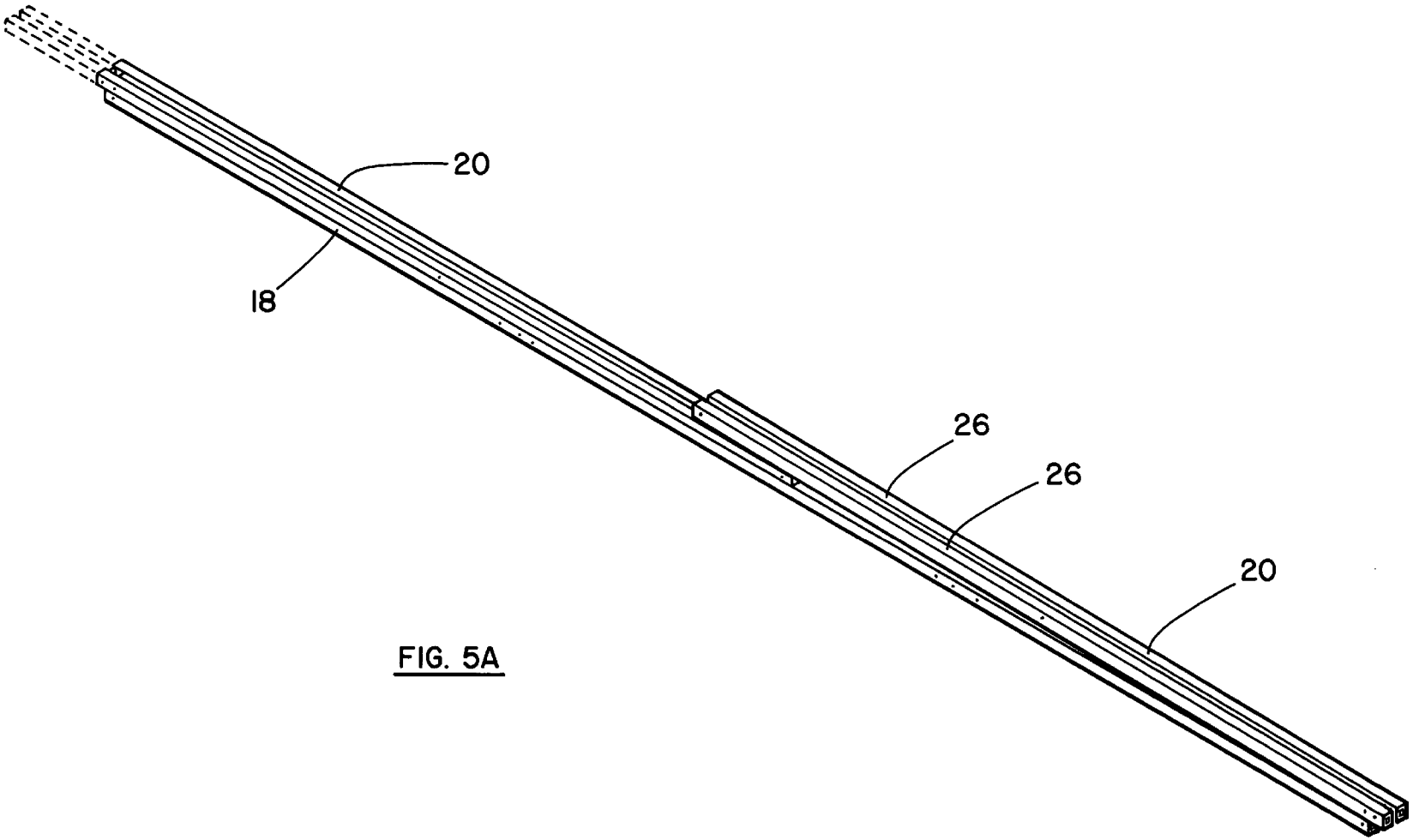
FIGS. 5*a* and 5*b* are a perspective views of first embodiment trusses shown in collapsed positions.
Figure 5B:
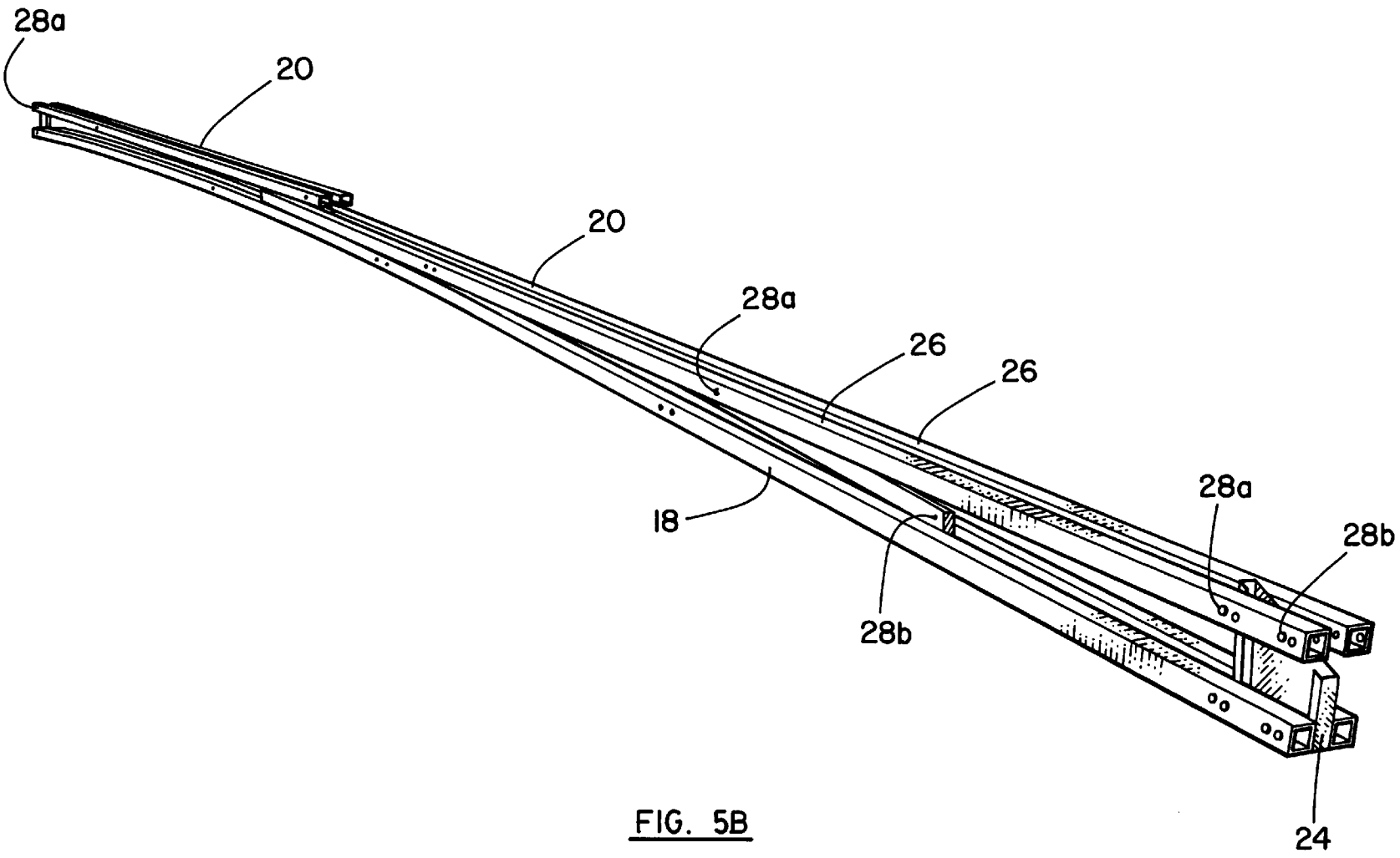

The truss may be partially pre-assembled at the factory or other off-site location and then transported for final assembly and incorporation into the building structure. Particularly, nut and bolt combinations 28*a* are installed for partial assembly of the truss and the truss can then be shipped in an essentially collapsed form, as illustrated in FIG. 5*a* corresponding to the embodiment of FIGS. 4*a*, 4*b*, 6*a* and 6*b*. FIG. 5*b* shows the collapsed form of the embodiment of FIGS. 1, 3*a*, 3*b*, and 3*c*. Once on the site of the building, the remaining nut and bolt combinations 28*b* are installed, the gusset plate is installed and the truss fastened atop studs 34 by means of a bolt which extends vertically through the tie beam to anchor 36 fastened between parallel upright chords of the supporting studs 34.

The tie beam of the truss of FIG. 2 is about twenty-five feet (about 7.62 meters) in length and is of a single piece. The rise over run of the rafter is about 5/12, the acute angle between each rafter and the tie beam being about 23°. Each chord of the tie beam and rafters is about 1½ inch (about 3.81 centimeters) squared while the struts are about 1 inch (about 2.54 centimeters) squared in outer cross-sectional dimension.

Each eave extension 16 is composed similarly to the truss in that it includes a rafter extension 38 made up of two spaced apart chords 26, a lower horizontal member 48 made up of two similarly spaced apart chords 26, and an end connector 24 which is essentially identical to the end connector used to fasten a rafter and tie beam of the truss to each other. Each eave extension also includes post 50. Components of the eave extension are made of materials the same as those of corresponding parts of the truss itself, post 50, which obtains an upright position when fully assembled and installed, corresponding to a strut of the truss.

The lower horizontal member of the eave extension is about two feet (about 60.96 centimeters) in length.

Like the truss, the eave extender can be partially assembled and transported in a collapsed condition. See FIGS. 7 and 8. Again, nut and bolts combinations 28*a* can be pre-installed at the factory and nut and bolt combinations 24*b* installed through factory-drilled holes 32 on-site.

Eave extension 16 is installed by means of nut and bolt combinations 52 to connector 24 of the truss and chord 54 of stud 34, holes for such installation being pre-drilled in post 50 and connector 24.

Figure 6C:
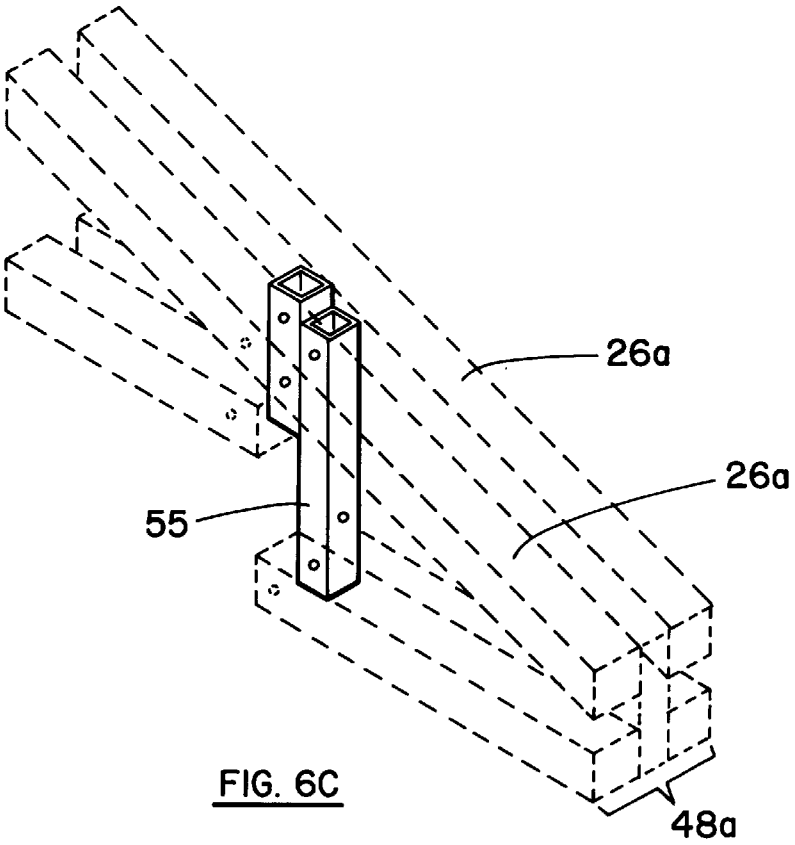
FIG. 6*c* is an isometric view of the FIG. 1 embodiment truss in which the rafter extends beyond the end of the tie beam to form an eave.
Figure 6B:
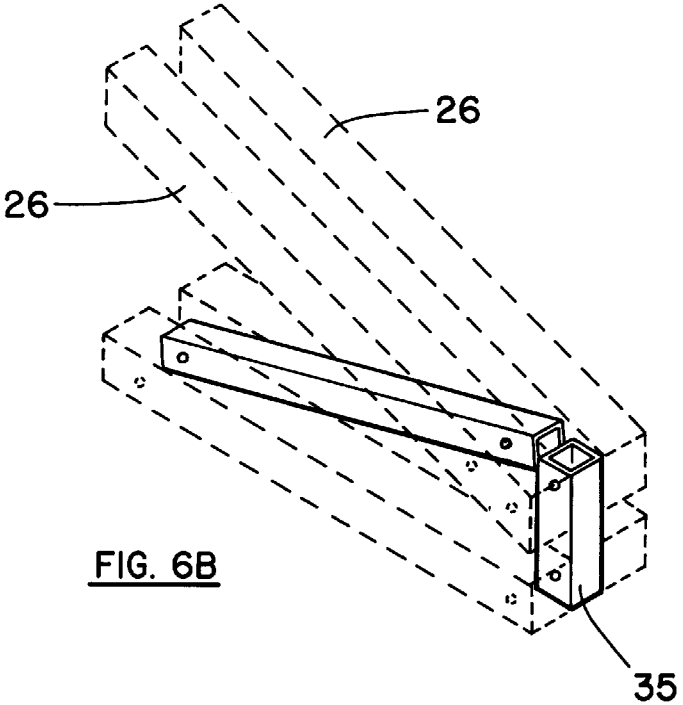
FIG. 6*b* is an isometric view of the same truss, with the rafter and tie beam shown in phantom.
Figure 6A:
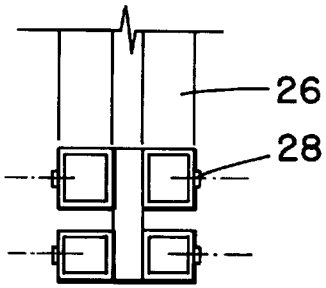
FIG. 6*a* is an end elevation of the truss shown in FIGS. 4*a* and 4*b*.
Figure 8:
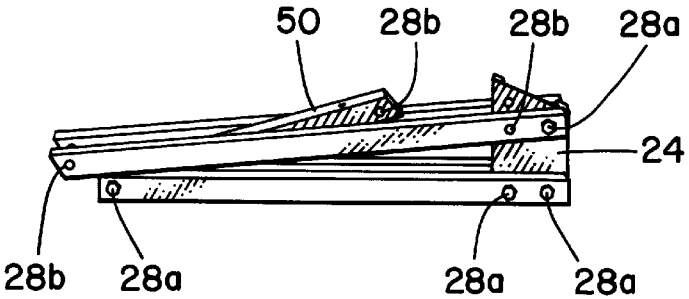
FIG. 8 is the eave extension shown in FIG. 7 in a fully collapsed position.
Figure 7:
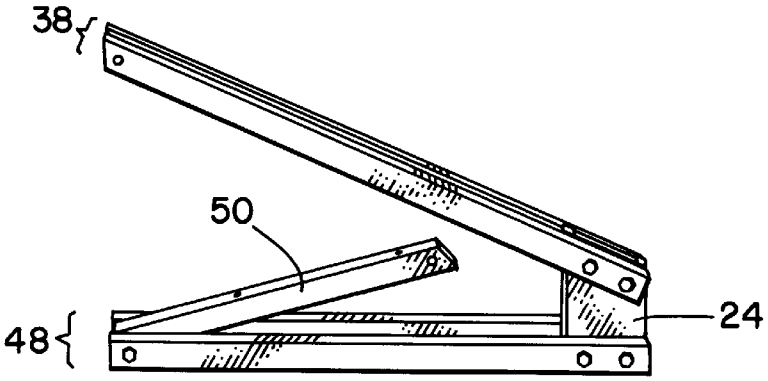
FIG. 7 is a side view of a partially collapsed eave extension of the FIG. 1 embodiment having an eave extension with an end connector similar to that shown in FIGS. 3*a* to 3*c*.

An alternate to a separate eave extension is shown in FIG. 6*c*. Rafter chords 26*a* extend beyond the end of the tie beam to provide a continuous slope. A lower horizontal member 48*a* is made up of two spaced apart chords, the inner ends of which are connected to each other and secured to the rafter chords by upright tubular connector 55.

All of the chord components of the truss described so far are made of galvanized steel tubing and the connector 24 is of galvanized steel. The bolts are cadmium plated, the dimensions being adequate for the required loading.

Figure 9A:
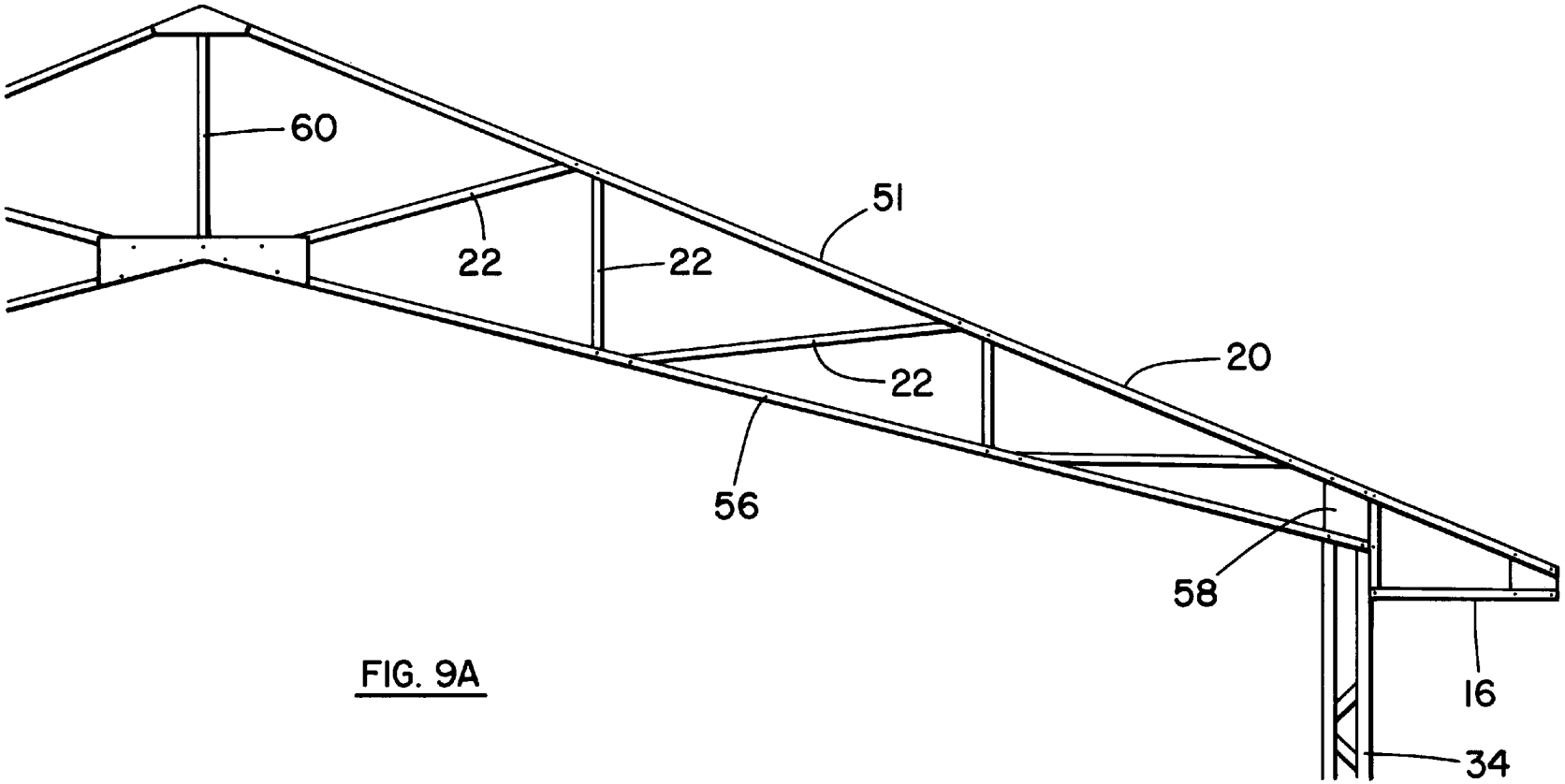
FIG. 9*a* is a partial side elevation of a scissor truss according to the first embodiment.
Figure 9B:
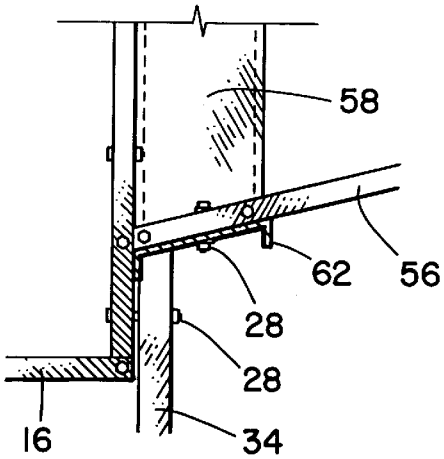
FIG. 9*b* is detail showing the connection of the scissor truss to a wall stud.

A scissor truss 51 spanning twenty-five feet is shown in FIGS. 9*a* and 9*b*. In this instance, the truss could be partially assembled offsite in two parts, each part including one rafter 20 and lower beam 56, connecting struts 22 and end connector 58. Center post 60, and gusset plate would be incorporated into the assembled truss on-site. A detail of the wall stud and scissor truss connection is shown in FIG. 9*b*. Plate 62 is bolted to stud 34 and lower beam 56 of the truss is in turn fastened to plate 62 by nut and bolt combination 28. Nut and bolt combinations 28*a* are installed for partial assembly of the truss, the remaining nut and bolt combinations 28*b* being installed on-site. Eave extenders 16 are similar to those described previously.

Figure 10:
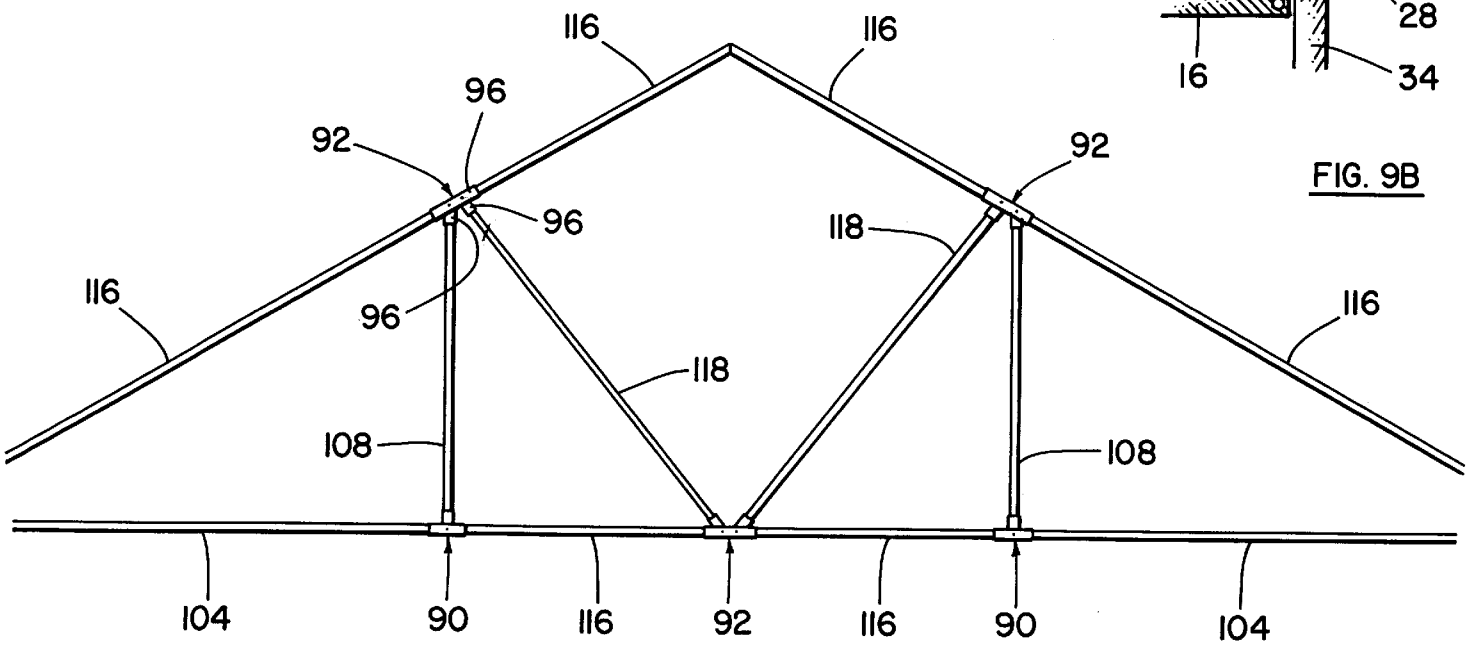
FIG. 10 shows a partial side elevation of a truss according to the first embodiment in which chords are interconnected by coupling members having pivotally connected tubes.

In particular circumstances, it may be desirable to have a truss, such as that shown in FIG. 10, for example, which when in its collapsed position does span the entire length of the fully assembled truss. In such situations, a truss could include members joined by chord couplings 90, 92, as appropriate. See FIGS. 10 and 11*a* to 11*c*.

Each coupling includes three or more tubes 96 pivotally connected to each other for insertion therein of chords of rafter, tie beam, strut or other spanning members of truss.

Figure 11A:
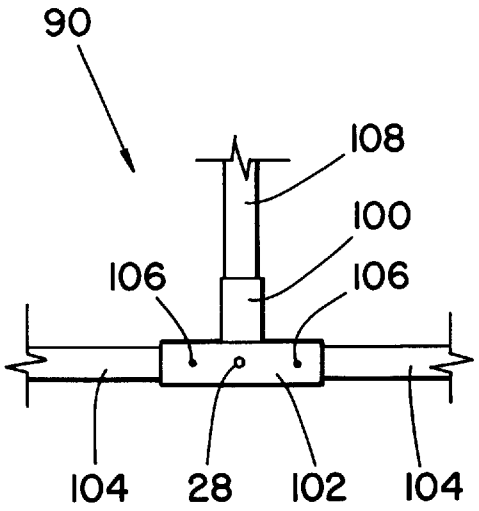
FIGS. 11*a* to 11*c* are enlarged details of the of coupling members shown in FIG. 10.
Figure 11C:
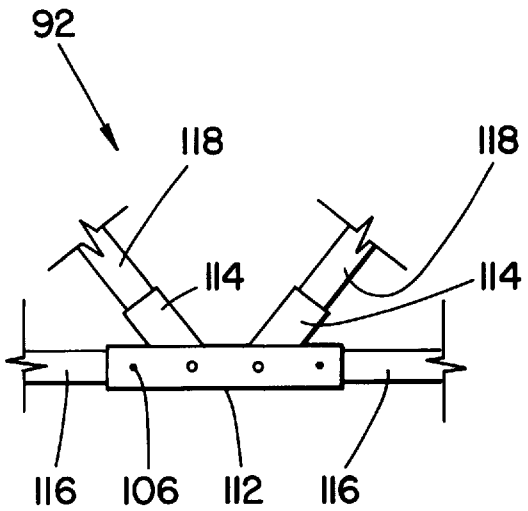
Figure 11B:
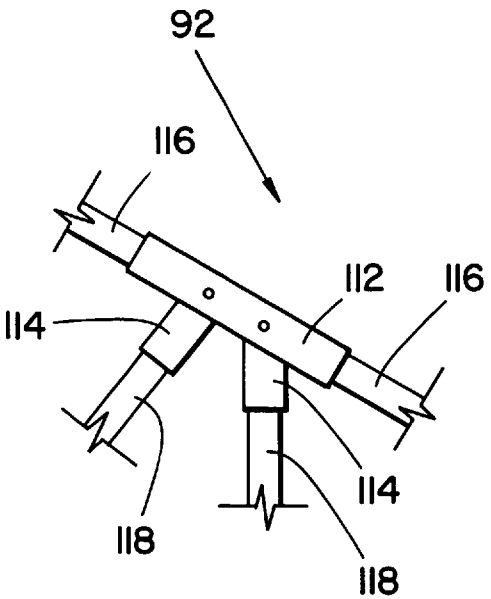
Figure 12A:
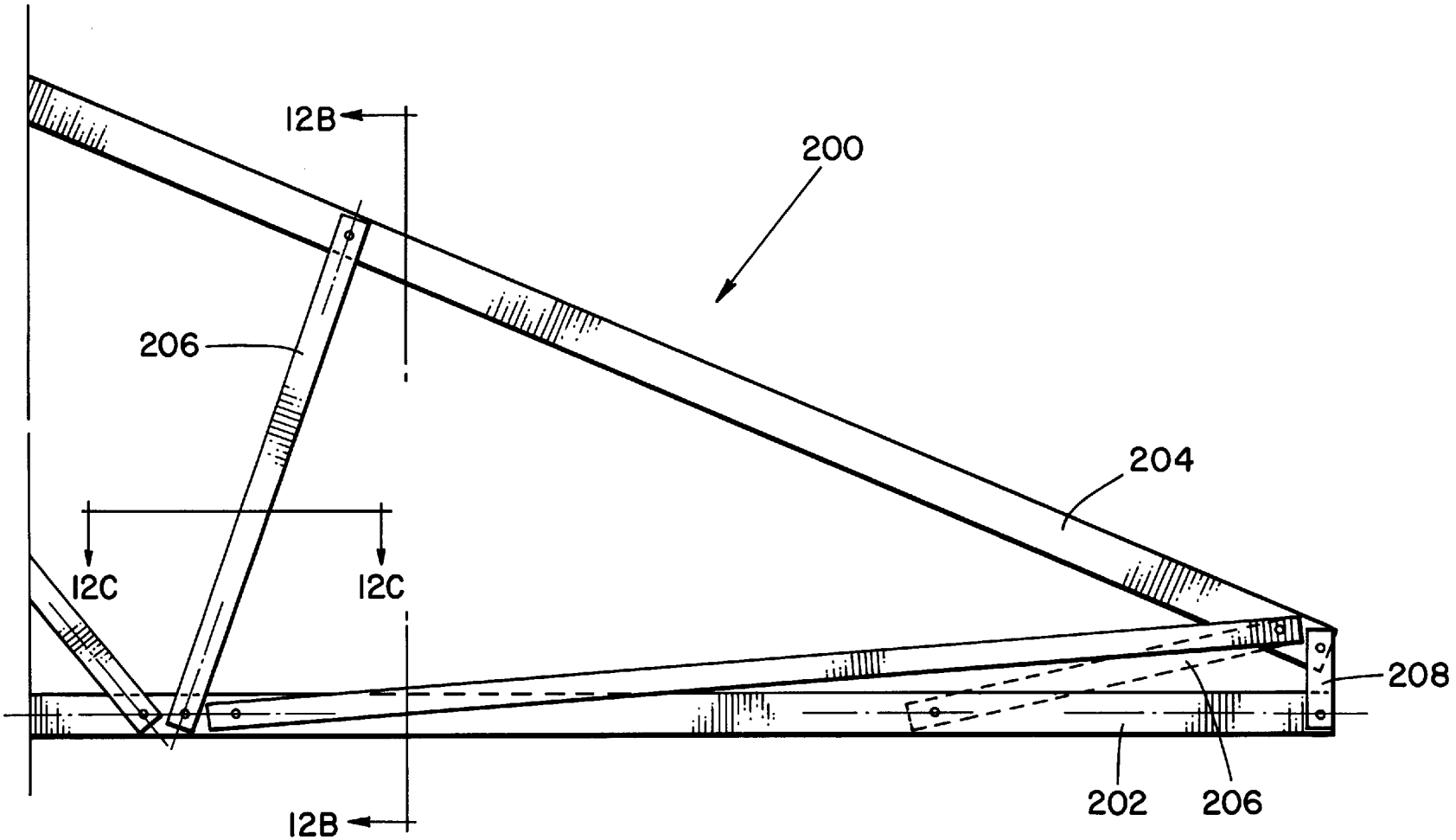
Figure 12C:
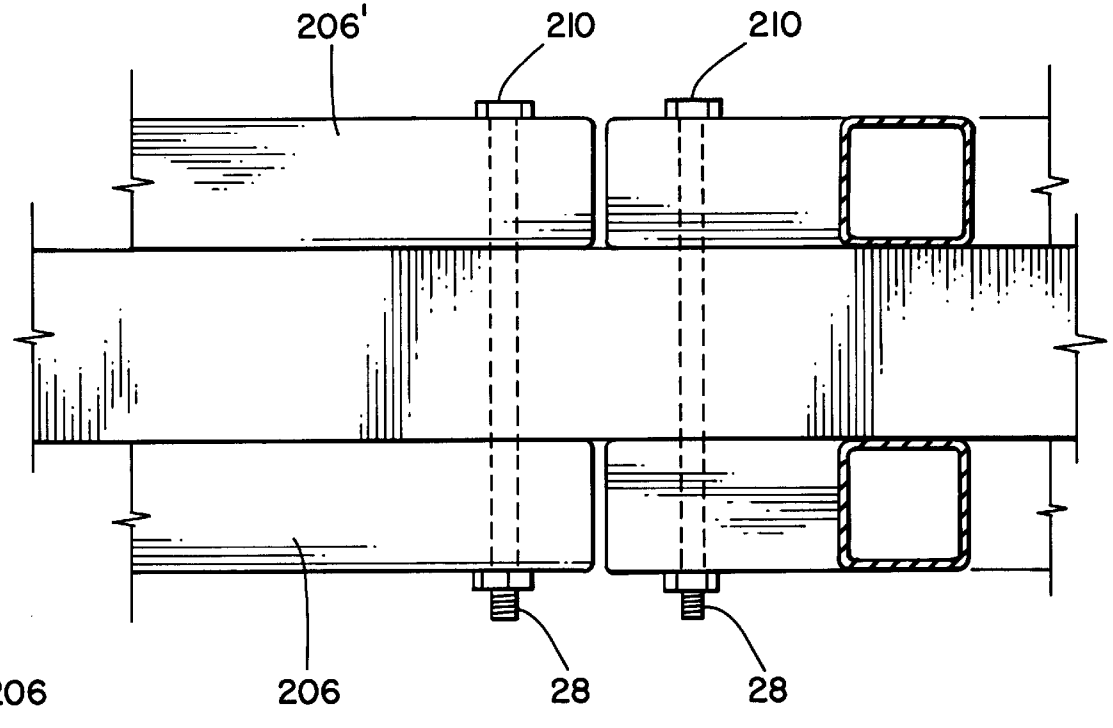
Figure 12B:
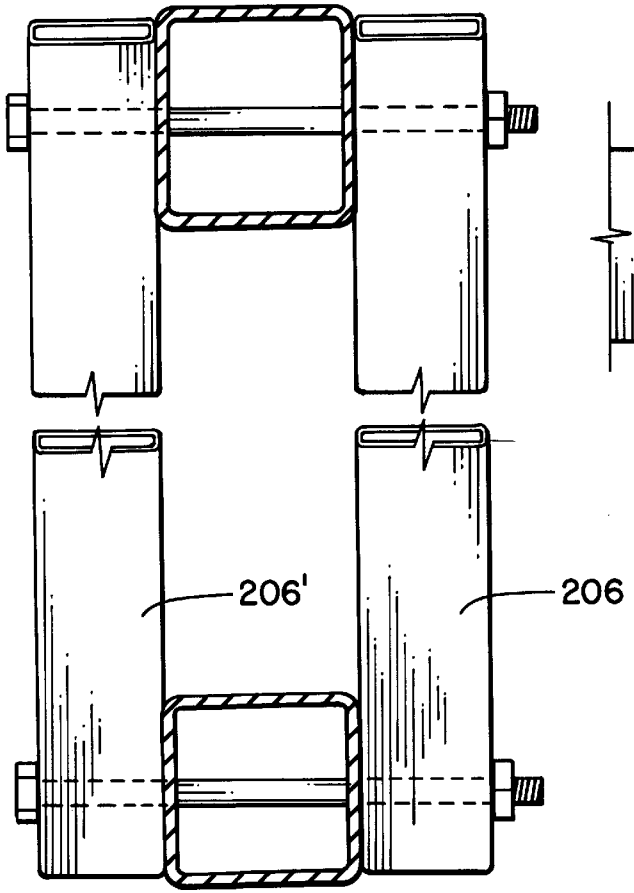

Coupling 90 includes three hollow tubes pivotally connected by nut and bolt combination 28 at its pivot point. Tubes 100, 102 (only one of tubes 100 is visible in FIG. 11*a*) are dimensioned for receipt therein of first and second chords of a rafter or tie beam, as the case may be, and the chord of a strut. Tube chords 104 of a tie beam, for example, are received within tube 102 and secured therein by self tapping screws 106. A corresponding pair of tubes, not visible in FIG. 11*a*, are similarly secured within a second similar tube of the coupler 90. The end of a single strut 108 is similarly received within tube 100 and secured by a self tapping screw.

Chord connector 92 includes two hollow tubes, 112 (only one visible in FIG. 11*b*) and two hollow tubes 114 pivotally connected between spaced apart tubes 112. Tie beam or rafter chords 116 received within tubes 112 are secured therein by self tapping screws. Strut chords 118 are also secured by self tapping screws.

The placement of couplers 90, 92 is illustrated in FIG. 10, other desired configurations being possible.

The interior walls of the tubes of the couplers can be pinched in or otherwise configured to regulate the distance into which the tube a chord is received.

Through the use of such couplers, a truss can be shipped to a building site wholly or partially disassembled. As with other trusses shown in this specification, selected pivotal connections can be omitted at a factory or other off-site truss assembly location to permit the chords of the truss to be retained in a collapsed position for convenient shipping and/or storage.

Turning to FIGS. 12*a* to 12*d*, exemplary portions of a second embodiment truss 200 arrangement are shown. In this embodiment, each tie beam 202 is made up of a single hollow 1½ inch by 1½ inch (about 3.8 cm by 3.8 cm) chord. Likewise each rafter 204, only one of which is shown, is made up of a single hollow 1½ inch by 1½ (about 3.8 cm by 3.8 cm) chord. It is possible, of course, for there to be a number of chords coupled end-to-end making up a single tie beam or rafter. There are paired chords 206, 206' making up the struts. Each of the struts in this case are 1 inch by 1 inch (about 2.54 cm by 2.54 cm) in external cross-sectional diameter. The chords of the tie beam, rafters and struts are of 12, 14, 18, 20 or any other suitable gauge galvanized steel. Each rafter 204 and tie beam 202 are connected in the eave region of the truss by upright tubular members 208, similar in gauge and cross section to the struts, by bolts 210 received through pre-drilled communicating apertures of the respective chords being connected. A truss of this sort could typically have a tie beam 50 feet (about 15½ meters) in length with the rise/run of the sloped rafters being about 5/12. Other slopes are, of course, possible. A truss constructed in accordance with the second embodiment, just as a truss of the first embodiment, could be partially assembled with selected bolts missing and the chord members pivotally collapsed about the installed bolts into a relatively compact configuration for shipping and storage.

FIGS. 13*a* to 15 illustrate a truss 300 of a third embodiment of the invention. As with the second embodiment, each tie beam 302 and rafter 304 is made up of a single hollow chord or of a greater number of chords coupled end-to-end. The chords of the tie beam and rafters of the FIG. 13 truss have an external cross section of 1¾ inch by 1¾ inch (about 4.45 cm by 4.45 cm). Struts 306 have a squared outer cross-sectional dimension of 1½ inch (about 3.8 cm). The struts are connected to the tie beam and raft means of gusset plates 308 which are made of bent sheet metal. The metal of gusset plates 308 is 16 Ga steel. Each gusset plate is connected to chord members by nut and bolt combinations 28.

Each gusset plate 308 has a first portion 310, an inner face of which is in abutting facing contact with the outer wall 312 of the tie beam or rafter chord to which it is boltingly secured. In order to accommodate the struts having a horizontal cross dimension smaller than that of the chords of the tie beam and rafters, each gusset plate 308 is bent to have an inwardly offset portion 314. Distance "D" between the two inner faces of opposing gusset plates 308 is thus equal to about 1½ inches (about 3.8 cm).

In the third embodiment illustrated in FIGS. 14*a* to 14*d*, the chords of tie beam 316, rafters 318, and struts 320 all have the same outer cross-sectional dimensions. Gusset plates 322 are thus flat.

The gusset plates are affixed against movement with respect to the chords of the tie beam or a rafter, as the case may be, by nut and bolt combinations 324. Similar nut and bolt combinations 326 provide a pivotal connection of the struts between the opposing extended portions of the gusset plates. In a fully assembled truss, of course, the struts are fixed against movement with respect to the other members of the truss. If one of the two bolting arrangements holding a strut in placed is not engaged then the strut can be pivotally moved about the axis of the remaining bolt holding it between the gusset plates. A truss constructed in accordance with the third embodiment, just as a truss of the other embodiments, can be partially assembled with selected bolts missing and the chord members pivotally collapsed about the installed bolts into a relatively compact configuration for shipping and storage.

End connectors are provided in third embodiment trusses by gusset plates 328, 330. Gusset plates 328 are shaped to accommodate the configuration of the chords fastened to it in a fully assembled truss, in much the same way that gusset plates 308 are bent, which in this case gives a strengthening effect to gusset plates 328. Gusset plates 330 are generally flat, but can include bent portion 332 which acts as a stiffener for gusset plates 330. Pre-drilled holes of gusset plates 328, 330, like those of end connectors 24 shown in FIG. 3*b*, are drilled along upper and lower lines which match the rise/run of a rafter with respect to the lower tie beam.

Figure 13A:
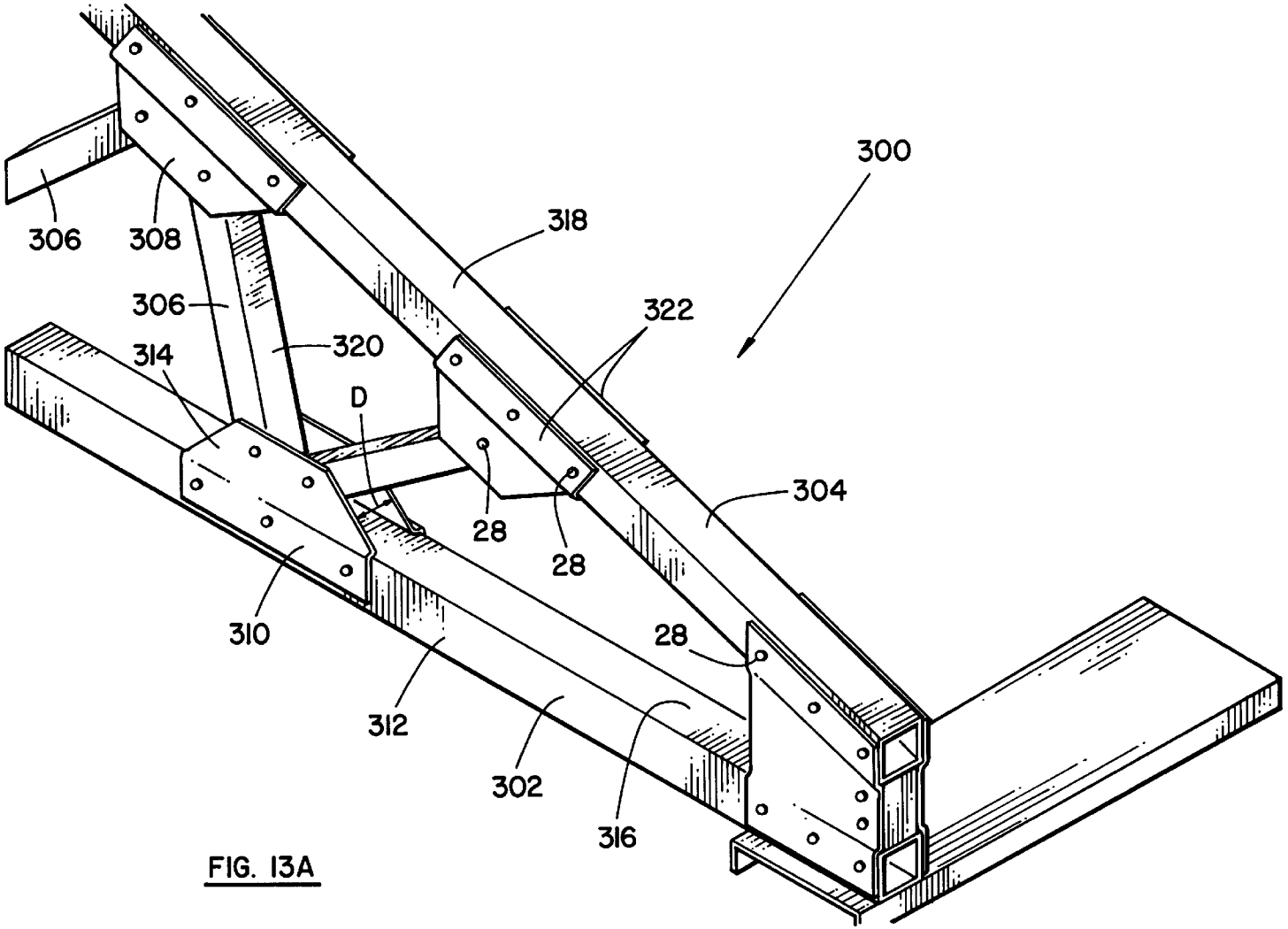
FIGS. 13*a*–13*d* show a truss according to a third embodiment of the invention.
Figure 13B:
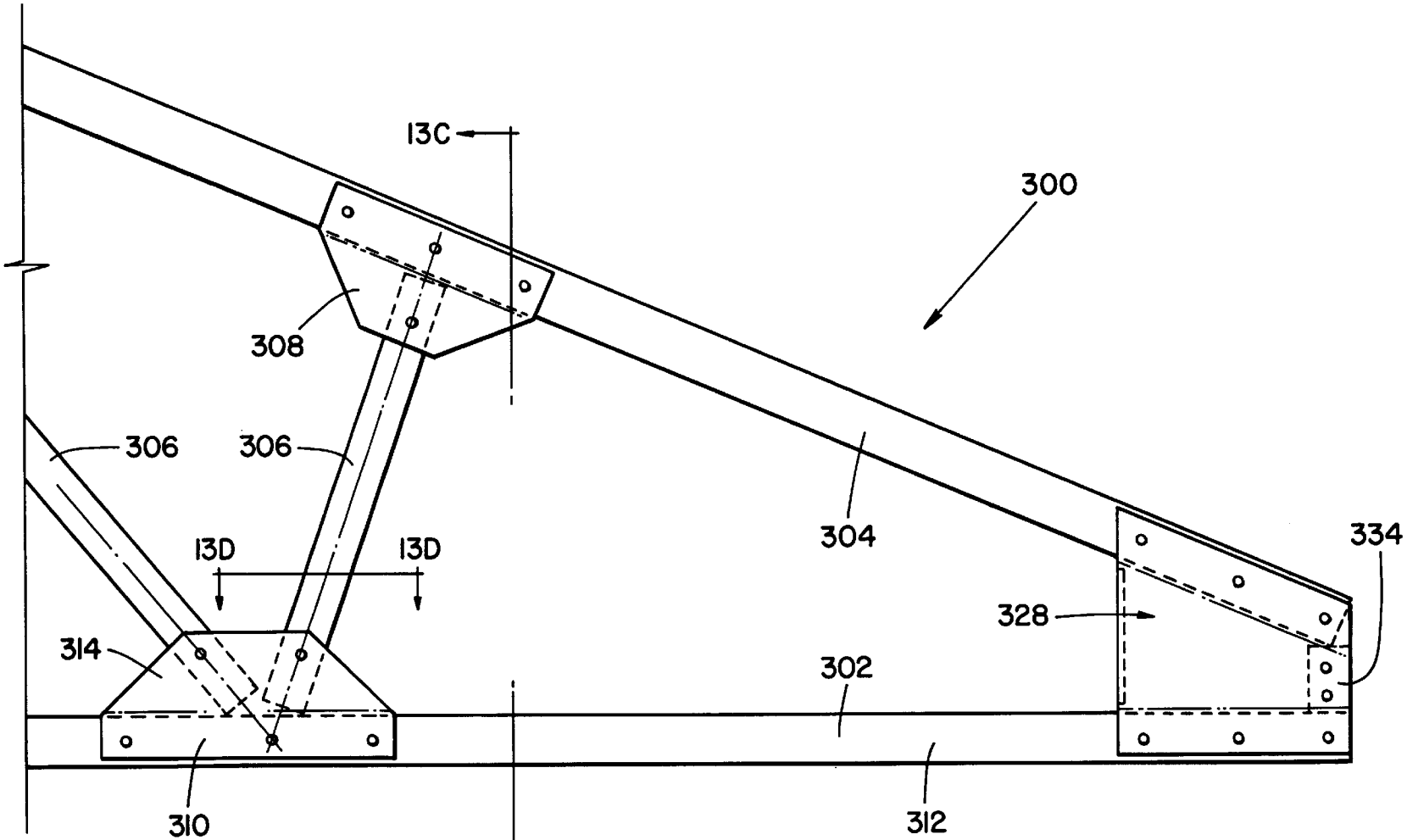
Figure 13D:
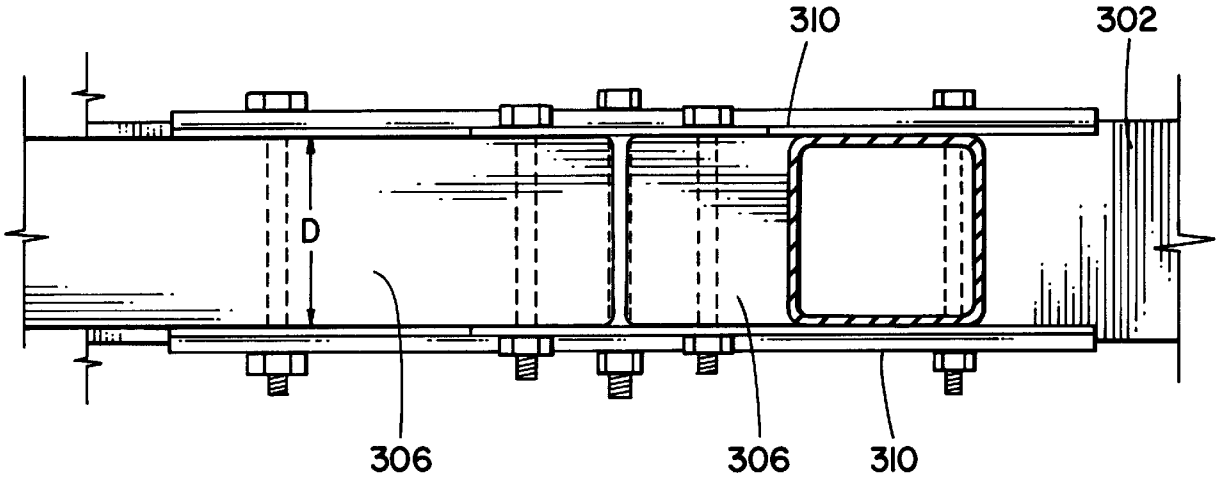
Figure 13C:
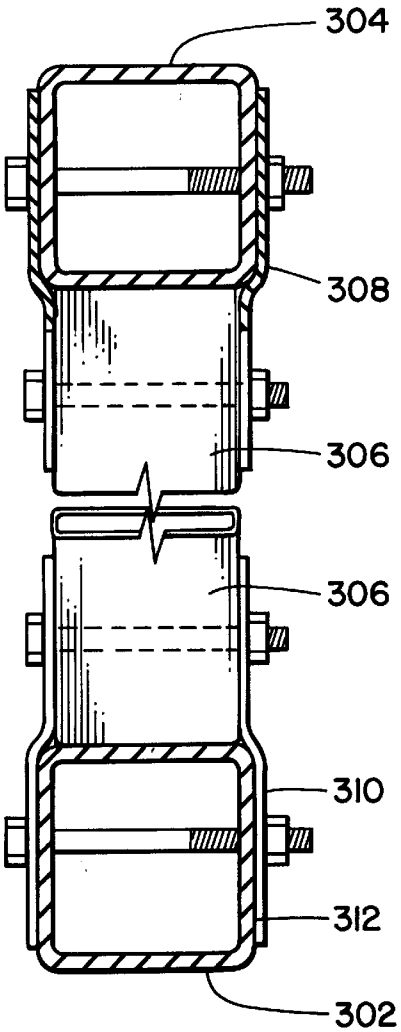
Figure 14A:
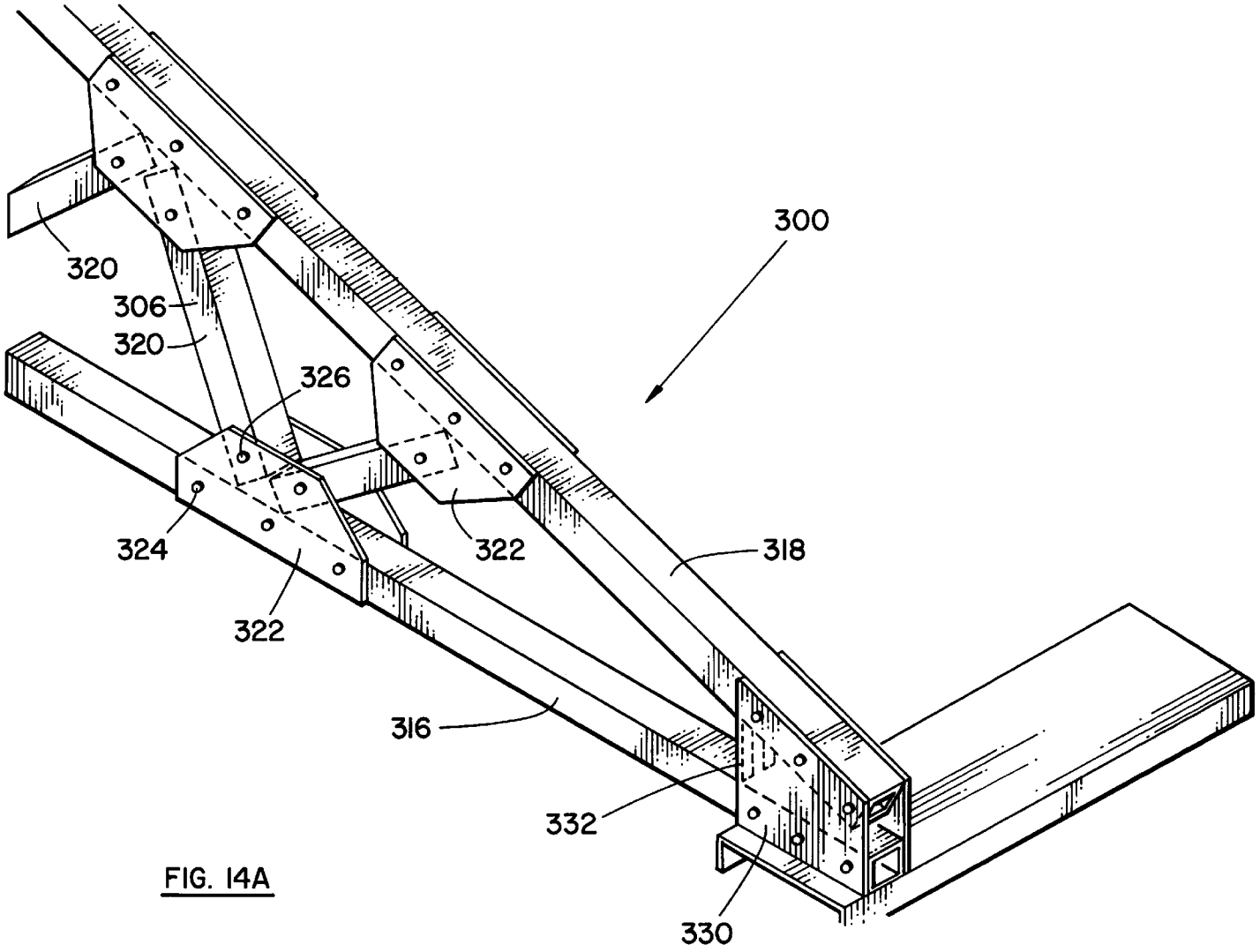
FIGS. 14*a*–14*d* show a truss of the third embodiment incorporating flat gusset plates for connecting tubular members and in which an upright tubular member is used to strengthen the eave area of the truss.
Figure 14B:
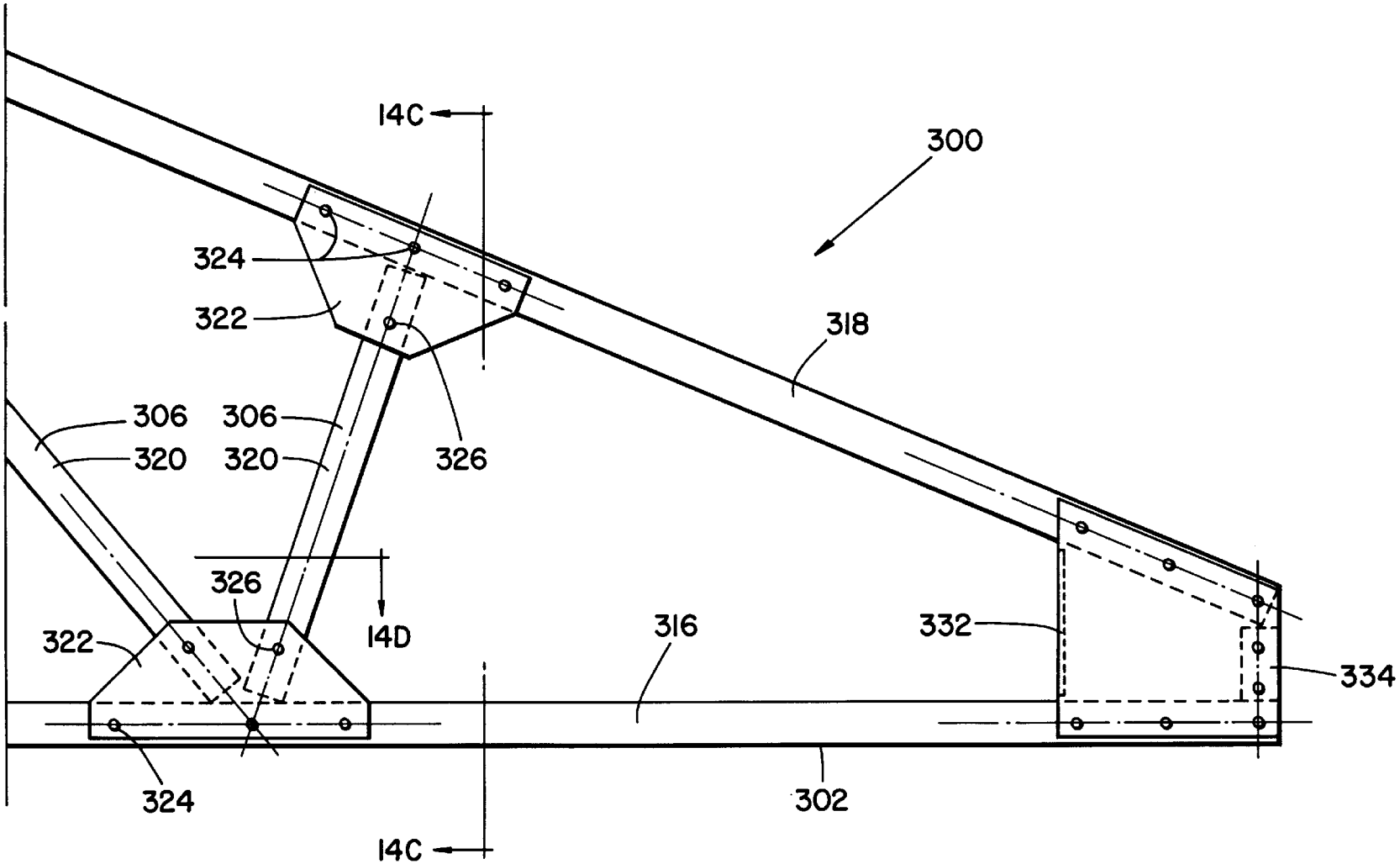
Figure 14D:
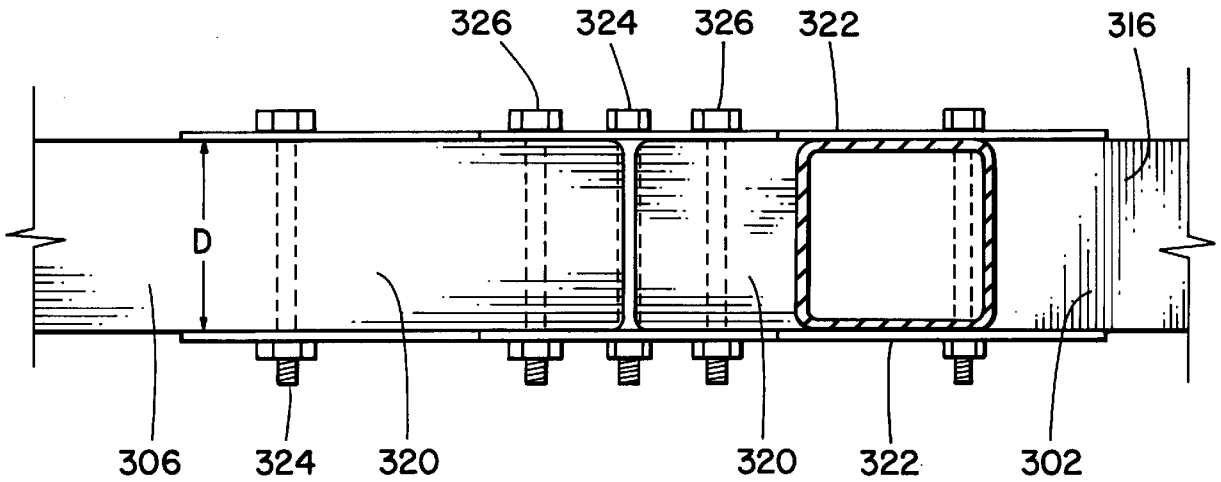
Figure 14C:
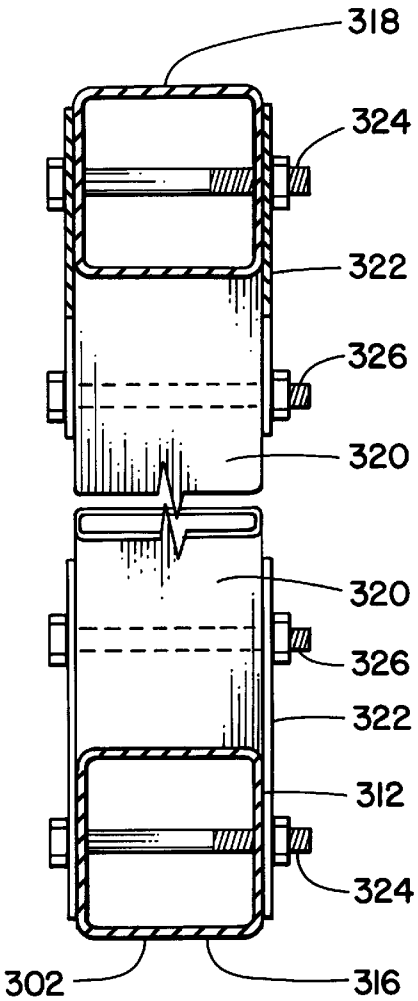
Figure 15:
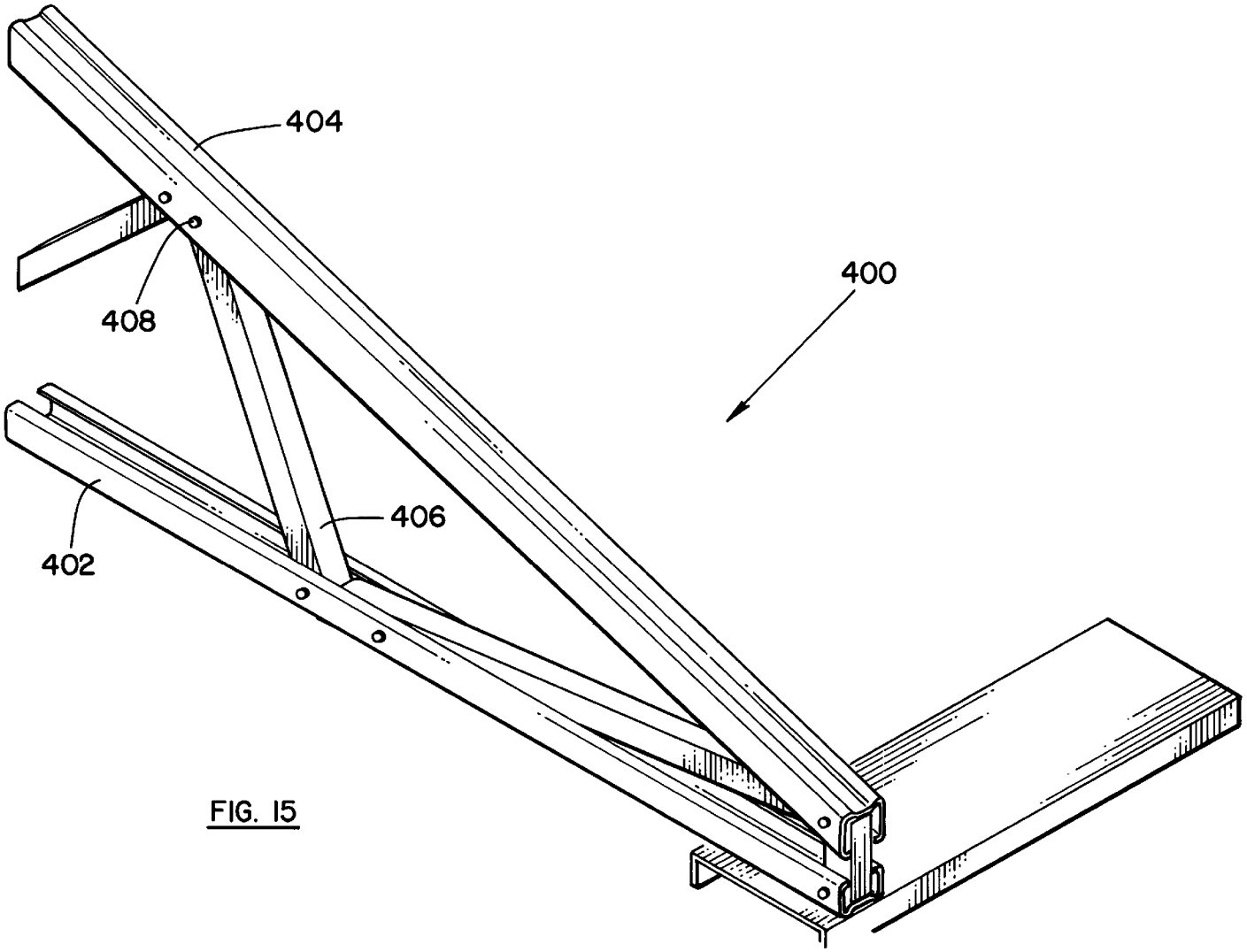
FIG. 15 is an isometric view of a portion of a truss according to a fourth embodiment o invention.
Figure 16:
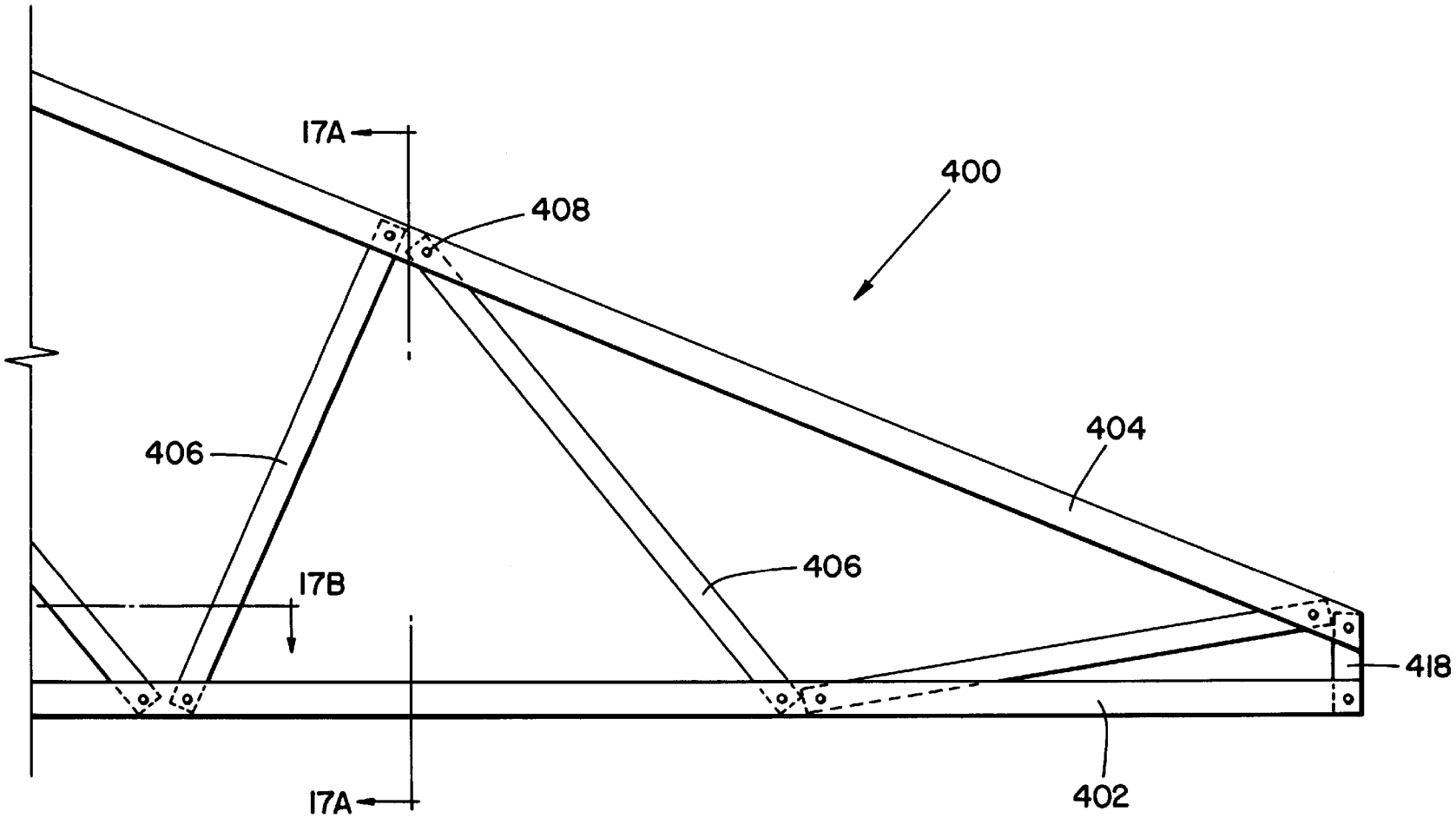
FIG. 16 shows a partial side elevation of the truss shown in FIG. 16.
Figure 17B:
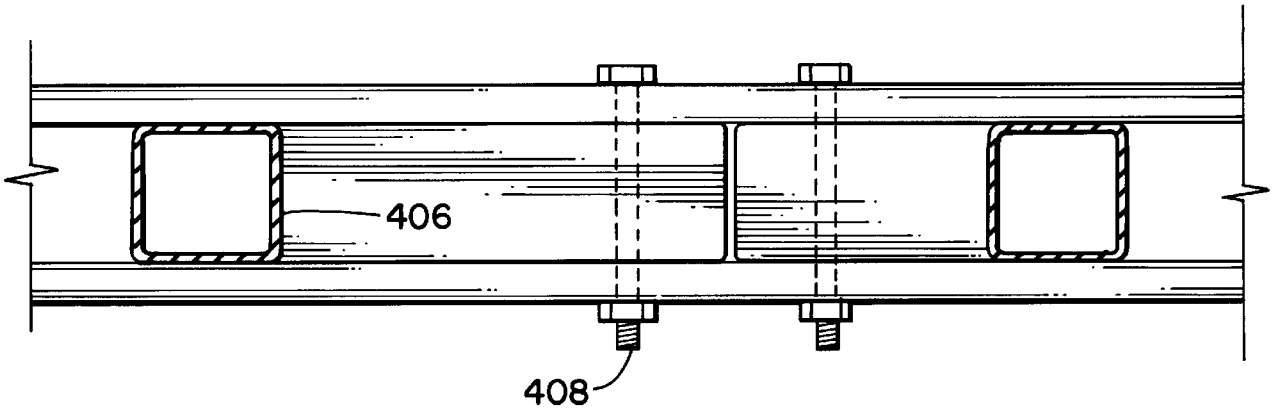
FIGS. 17*a* and 17*b* are partial sections taken along a—a and b—b, respectively, of FIG. 16.
Figure 17A:
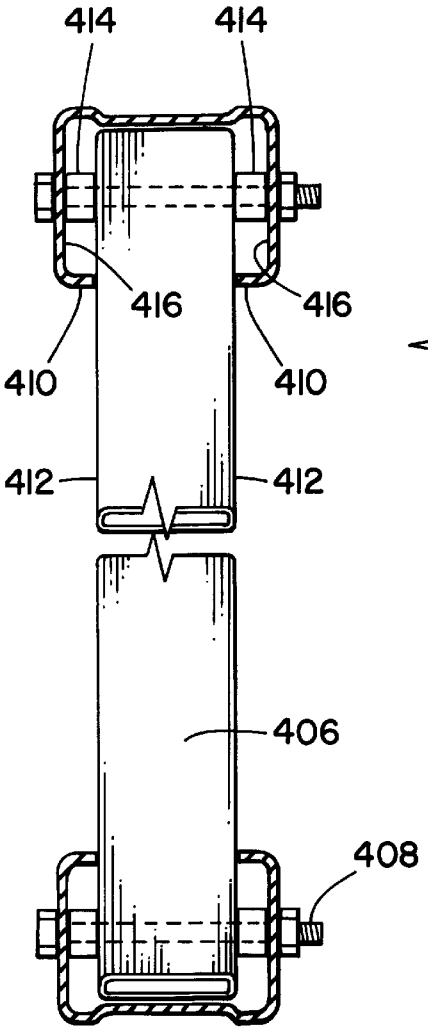

A further variation between the eave area connection between a rafter and tie beam is shown in FIGS. 13*b* and 14*b*. In FIG. 14*b* an arrangement in which the gusset plates are further strengthened by tubular member 334 is shown. In FIG. 14*a*, the vertical distance between the tie beam and rafter chords is much smaller than that shown in FIG. 14*b*, and the additional strength provided by upright member 334 is not required, A fourth embodiment truss 400 is shown in FIGS. 15 to 17*b*. In this instance, chords for lower tie beam 402 and rafter 404 have a "C"-shaped cross section, which can most readily be seen in the detail of FIG. 17*a*. The illustrated chords are 1¼ inch by 1⅝ inch (about 3.2 cm by about 4.1 cm) N.C. channel chords of galvanized G90 14, 16, 18, 20, or any other suitable gauge rollformed steel. Struts 406 of the illustrated fourth embodiment have an outer cross-sectional dimension of 1 inch by 1 inch (about 2.5 cm by 2.5 cm). Each end of a strut is received within the channel or bight of tie beam or a rafter when the truss is fully assembled. The shanks of bolts 408 are received through pre-drilled communicating apertures of the strut and tie beam or of the strut and a rafter, as the case may be.

Lips 410 of the "C"-shaped chords depend inwardly from the outer sides 412 of the chords of the tie beam and rafters. Spacers 414 are used to accommodate the difference in the distance between the inner faces of walls 416 and the external thickness of the struts. This permits the pivoting of a strut with respect to the "C"-shaped chord as required during assembly of the truss and precludes deformation of the "C"-shaped member as a nut is tightened onto its bolt.

An end connector is provided by upright tubular member 418 having pre-drilled holes for receipt of bolt shanks therethrough.

What is claimed is:

1. A building truss for supporting a sloped roof comprising a lower beam, an upper rafter and a strut connecting the rafter to the lower beam, wherein:

each of the rafter and beam includes a metal chord, which chords are located in a first plane;

each strut includes a metal chord located in a second plane parallel to the first plane;

there is a connection between a lower end of the strut chord and the beam chord and there is a connection between an upper end of the strut chord and the rafter chord, when the truss is fully assembled; and a first of the connections is a pivotal connection having a pivotal axis orthogonal to the planes which connection permits, when a second of the connections is disconnected, side-by-side pivotal movement of the strut chord relative to at least one of the other chords of the truss whereby the chords of the truss may be moved into a collapsed position for storage and transport of the truss and wherein each of the lower beam and rafter includes first and second parallel and co-extending chords of separate section, with respective ends of the strut interposed therebetween.

2. The truss of claim 1 wherein:

each chord has a pair of preformed communicating apertures therein for receipt of a shank of a said bolt therethrough when the truss is fully assembled.

3. The truss of claim 1 wherein:

the chords of the beam and the rafter of the fully assembled truss are connected to each other by a connector interposed therebetween, the connector being of generally "C"-shaped horizontal cross section.

4. The truss of claim 3 wherein:

each chord and the connector each has preformed apertures therein, located to be in communication with each other, for receipt of a shank of a bolt therethrough when the truss is fully assembled.

5. The truss of claim 3 wherein:

the truss is generally triangular, there being two said rafters forming two upper sides of the triangle and the lower beam is horizontal and extends, end-to-end, between the connectors.

6. The truss of claimed 3 wherein:

the truss is a scissor truss, there being two said rafters forming two upper sides thereof, and there being a pair of said lower beams, each beam having an outer first end connected to a said connector and an inner second end connected to that of the other beam.

7. The truss of claim 6 wherein:

the lower beams of the fully assembled truss are connected to each other by a gusset plate.

8. The truss of claim 3, further comprising, when the truss is in the fully assembled condition:

an eave extension member connected at an end of the fully assembled truss, wherein:

the eave extension member comprises:

a first pair of parallel spaced apart metal chords, respectively collinear with the respective chords of the rafter;

a second pair of parallel spaced apart metal chords located, respectively, to be coplanar with and below the chords of the first pair of extension member chords;

a first extension member connector interposed between the pairs of chords, connecting the chords together; and a fastener connecting the extension member connector of the eave extension member and the connector interposed the chords of the beam and the rafter.

9. The truss of claim 1 wherein:

each of the chords of each said rafter, each said beam and each said strut is a hollow tube of generally rectangular cross section.

10. The truss of claim 1 wherein:

each of the pivotal connections includes a nut and bolt.

11. The truss of claim 10 wherein:

each chord of each said rafter, each said beam and each said strut has a pair of preformed communicating apertures therein for receipt of a shank of a said bolt therethrough when the truss is fully assembled.

12. The truss of claim 1 wherein, in the fully assembled truss:

the rafter and beam chords are connected at an eave end thereof to each other by a metal member; and the truss further comprises an eave extension member comprising:

a first metal chord collinear with chord of the rafter;

a second mental chord connected to the first metal chord and located to be coplanar with and below the first chord; and a metal connector connecting the first and second chords and being connected to the metal member, to secure the eave extension member at the eave end of the truss.

13. The truss of claim 9 wherein:

each of the pivotal connections includes a nut and bolt.

* * * * *